US010088197B2

(12) United States Patent
Hamagami et al.

(10) Patent No.: US 10,088,197 B2
(45) Date of Patent: Oct. 2, 2018

(54) WATER HEATING APPARATUS AND WATER HEATING SYSTEM

(71) Applicant: NORITZ CORPORATION, Hyogo (JP)

(72) Inventors: Toshihiko Hamagami, Kobe (JP); Yu Fujimoto, Kakogawa (JP); Shota Mizuno, Akashi (JP); Ryo Hasegawa, Kakogawa (JP); Yoshihiro Nunotani, Kakogawa (JP); Akira Iwasaki, Kobe (JP)

(73) Assignee: NORITZ CORPORATION, Hyogo (JP)

( * ) Notice: Subject to any disclaimer, the term of this patent is extended or adjusted under 35 U.S.C. 154(b) by 53 days.

(21) Appl. No.: 15/293,447

(22) Filed: Oct. 14, 2016

(65) Prior Publication Data

US 2017/0108242 A1 Apr. 20, 2017

(30) Foreign Application Priority Data

Oct. 16, 2015 (JP) ..... 2015-204471

(51) Int. Cl.
*F24H 9/00* (2006.01)
*F24H 1/14* (2006.01)
*F24H 9/20* (2006.01)

(52) U.S. Cl.
CPC ..... *F24H 9/0042* (2013.01); *F24H 1/145* (2013.01); *F24H 9/2035* (2013.01)

(58) Field of Classification Search
CPC ..... F24H 9/0042; F24H 1/145
See application file for complete search history.

(56) References Cited

U.S. PATENT DOCUMENTS 4,501,261 A * 2/1985 Tsutsui ..... F23N 1/082 122/14.3
5,571,007 A * 11/1996 Ishiguro ..... F23N 5/242 122/14.2
6,236,321 B1 * 5/2001 Troost, IV ..... F24H 9/0042 126/116 A
9,004,017 B2 * 4/2015 Narita ..... F24H 9/2035 122/14.1
9,410,708 B2 * 8/2016 Taylor ..... F28G 9/00
2007/0257122 A1 * 11/2007 Shimada ..... F23N 1/082 237/12
2008/0128032 A1 * 6/2008 Lapetina ..... B08B 3/026 137/334
2010/0212752 A1 * 8/2010 Fima ..... F24H 9/2007 137/87.03

(Continued)

FOREIGN PATENT DOCUMENTS

JP 2015-102323 A 6/2015

*Primary Examiner* — Gregory A Wilson
(74) *Attorney, Agent, or Firm* — Studebaker & Brackett PC

(57) ABSTRACT

A water heating apparatus includes: a water heating circuit; a heater for heating the water heating circuit; and a controller for controlling the water heating apparatus. The water heating circuit includes a heat exchanger for heating a fluid including water and hot water, and a pipe for supplying the fluid via the heat exchanger. The controller is configured to drive the heater in a cleaning mode in which a cleaning liquid for cleaning an inside of the heat exchanger is supplied to the heat exchanger through the pipe.

13 Claims, 15 Drawing Sheets

(56) References Cited

U.S. PATENT DOCUMENTS

| | | | | |
|---|---|---|---|---|
| 2013/0048028 | A1* | 2/2013 | Morin | F24H 9/0042 134/22.1 |
| 2015/0144074 | A1 | 5/2015 | Fujimoto et al. | |
| 2017/0088442 | A1* | 3/2017 | Everson | C02F 1/42 |

* cited by examiner

WATER HEATING APPARATUS AND WATER HEATING SYSTEM

BACKGROUND OF THE INVENTION

Field

The present disclosure relates to a water heating apparatus and a water heating system, and particularly to a water heating apparatus and a water heating system each having a function of detecting clogging with scale.

Description of the Related Art

Use of a water heating apparatus for a long time causes scale to adhere to an inside of a pipe of a heat exchanger. In particular, in the case where so-called hard water containing a large quantity of calcium ions and magnesium ions is used, the amount of adhesion of the scale becomes greater. When use of the water heating apparatus with adhesion of the scale continues, normal heat transmission of the heat exchanger may be impaired by the scale, thus damage such as cracks in the heat exchanger may occur due to generation of thermal stress caused by the scale. Accordingly, it is necessary to perform cleaning for removing the scale at an appropriate timing. For example, Japanese Patent Laying-Open No. 2015-102323 discloses a method of cleaning away scale in a water heating apparatus.

SUMMARY OF THE INVENTION

Although Japanese Patent Laying-Open No. 2015-102323 discloses a water heating apparatus that is rendered convenient due to cleaning away of scale, there has been a demand for providing a water heating apparatus and a water heating system with more excellent convenience.

An object of an aspect of the present disclosure is to provide a water heating apparatus and a water heating system with improved convenience.

A water heating apparatus according to an aspect of the present disclosure includes: a water heating circuit; a heater for heating the water heating circuit; and a controller for controlling the water heating apparatus. The water heating circuit includes a heat exchanger for heating a fluid including water and hot water, and a pipe for supplying the fluid via the heat exchanger. The controller is configured to drive the heater in a cleaning mode in which a cleaning liquid for cleaning an inside of the heat exchanger is supplied to the heat exchanger through the pipe.

The heater includes a burner for heating the heat exchanger, and a heater for heating the pipe. The controller is configured to drive at least one of the burner and the heater in the cleaning mode.

The water heating apparatus further includes a flow rate sensor for measuring an amount of the fluid supplied to the heat exchanger. The controller is configured to end the cleaning mode when a cumulative value of a flow rate measured by the flow rate sensor from start of the cleaning mode reaches a first threshold value.

The water heating apparatus further includes a temperature sensor for measuring a temperature of the fluid in the heat exchanger. The controller is configured to control the water heating apparatus so as to perform heating of the heat exchanger by the burner for a predetermined time period while causing the fluid to flow through the heat exchanger in the cleaning mode, and to end the cleaning mode when an increased value of the temperature measured in a state where the fluid is stopped after an end of the heating is less than a second threshold value.

The water heating apparatus further includes a flow rate sensor for measuring an amount of the fluid supplied to the heat exchanger. The controller is configured to accumulate, from start of the cleaning mode, a time period in which a flow rate measured by the flow rate sensor is equal to or greater than a third threshold value, to obtain a cumulative time period, and end the cleaning mode when the cumulative time period is equal to or greater than a predetermined time period.

A water heating apparatus according to another aspect of the present disclosure includes: a burner; a heat exchanger for heating a fluid with heat from the burner, the fluid including water and hot water contained inside; a pipe for supplying the fluid; and a controller for controlling the water heating apparatus. The pipe includes a supply pipe for supplying the fluid to the heat exchanger, a delivery pipe for delivering the fluid from the heat exchanger, and a bypass pipe for causing the fluid in the supply pipe to bypass the heat exchanger so as to be delivered to the delivery pipe. The water heating apparatus further includes a flow rate regulating unit for regulating a flow rate of the fluid in the bypass pipe. The controller is configured to control the flow rate regulating unit such that the flow rate in the bypass pipe is greater than a flow rate in the bypass pipe in a cleaning mode, when water is supplied in place of a cleaning liquid from the supply pipe to the heat exchanger after the cleaning mode in which the cleaning liquid is supplied from the supply pipe to the heat exchanger.

The flow rate regulating unit includes a valve. The controller is configured to control the valve such that an opening degree of the valve is greater than the opening degree in the cleaning mode when water is supplied in place of a cleaning liquid from the supply pipe to the heat exchanger after the cleaning mode in which the cleaning liquid is supplied from the supply pipe to the heat exchanger.

The water heating apparatus further includes a flow rate sensor for measuring an amount of the fluid supplied to the heat exchanger. The controller is for ending the cleaning mode when a cumulative value of a flow rate measured by the flow rate sensor from start of the cleaning mode reaches a first threshold value.

The water heating apparatus further includes a flow rate sensor for measuring an amount of the fluid supplied to the heat exchanger. The controller is configured to accumulate, from start of the cleaning mode, a time period in which a flow rate measured by the flow rate sensor is equal to or greater than a third threshold value, to obtain a cumulative time period, and end the cleaning mode when the cumulative time period is equal to or greater than a predetermined time period.

A water heating system according to still another aspect of the present disclosure includes: a plurality of water heating apparatuses; and a controller for controlling an operation of each of the plurality of water heating apparatuses based on information from each of the water heating apparatuses. Each of the plurality of water heating apparatuses includes a burner, a heat exchanger for heating water and hot water with heat from the burner, and a controller for controlling each of the water heating apparatuses. The controller is configured to, when a cleaning mode is started, transmit a start notification indicating start of the cleaning mode to the controller, the cleaning mode being for cleaning an inside of the heat exchanger of each of the water heating apparatuses. The controller is configured to, when the start notification is received, exclude any one of the water heating apparatuses as a sender of the start notification from a target for which the operation is to be controlled.

The controller is configured to, when the cleaning mode is ended, transmit an end notification indicating an end of the cleaning mode to the controller. The controller is configured to, when the end notification is received, reset any one of the water heating apparatuses as a sender of the end notification back to a target for which the operation is to be controlled.

The controller is configured to, when the cleaning mode is ended, transmit an end notification indicating an end of the cleaning mode to the controller. The controller is configured to: when the start notification is received from one or more of the water heating apparatuses, cause an output unit to start an output of notification data for giving a notification about implementation of the cleaning mode; and when the end notification is received from each of the one or more of the water heating apparatuses, cause the output unit to end the output of the notification data.

The controller is configured to: when the start notification is received from one or more of the water heating apparatuses, cause an output unit to start an output of notification data for giving a notification about implementation of the cleaning mode, the notification data including data that changes so as to show a progress of the cleaning mode; and when the start notification is received in a middle of the cleaning mode, cause the output unit to stop changing of the data showing the progress of the cleaning mode, and again to start changing of the data so as to show a progress from start of the cleaning mode.

The controller is configured to, when the start notification is received from one or more of the water heating apparatuses, cause an output unit to start an output of notification data for giving a notification about implementation of the cleaning mode, the notification data including data that changes so as to show a progress of the cleaning mode. Each of the water heating apparatuses further includes a flow rate sensor for measuring an amount of a fluid supplied to the heat exchanger. The controller is configured to accumulate a flow rate measured by the flow rate sensor from start of the cleaning mode, to obtain a cumulative flow rate. The data that changes includes data showing a progress of a time in the cleaning mode, or data showing a change in the cumulative flow rate in the cleaning mode.

The foregoing and other objects, features, aspects and advantages of the present invention will become more apparent from the following detailed description of the present invention when taken in conjunction with the accompanying drawings.

DESCRIPTION OF THE EMBODIMENTS

Figure 1:
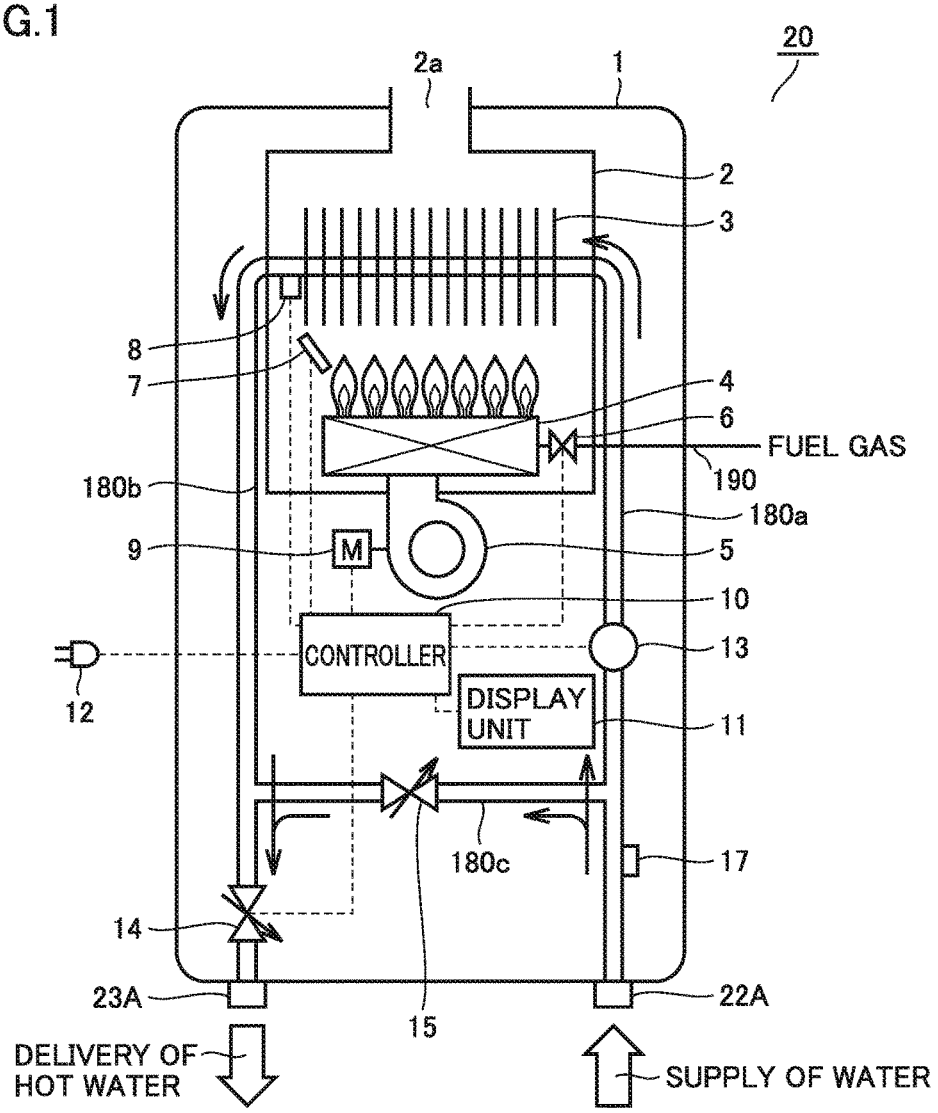
FIG. 1 is a configuration diagram of a water heating apparatus 20 according to the first embodiment.

Each embodiment will be hereinafter described in detail with reference to the accompanying drawings, in which the same or corresponding components are designated by the same reference characters, and description thereof will not be repeated in principle.

First Embodiment (Hardware Configuration of Apparatus)

FIG. 1 shows a configuration of a water heating apparatus 20 according to the first embodiment. Referring to FIG. 1, water heating apparatus 20 includes a case 1, a water heater body 2, a water heater body thermistor 8 serving as a temperature sensor, a controller 10, a display unit 11, a power supply plug 12, a flow rate sensor 13, a flow rate regulating valve 14, pipes 180*a*, 180*b*, 180*c*, a heater 17, and a gas pipe 190. Controller 10 outputs, to each component, the electric power supplied to water heating apparatus 20 via power supply plug 12. It should be noted that the arrow illustrated in FIG. 1 indicates a direction of a flow of a fluid. The fluid includes hot water, cold water, and a cleaning liquid employed in a cleaning mode for cleaning away the scale attached to heat exchanger 3. Heater 17 includes a heater for preventing the fluid from freezing inside water heating apparatus 20.

In case 1, there are arranged water heater body 2, controller 10, display unit 11, flow rate sensor 13, flow rate regulating valve 14, pipes 180*a*, 180*b*, 180*c*, and the like. In water heater body 2, there are arranged heat exchanger 3, a burner 4, and a blower 5. Water heater body 2 is provided with an exhaust port 2*a*.

Heat exchanger 3 serves to heat fluid including water and hot water with use of heat from burner 4, and specifically performs heat exchange with combustion gas generated at burner 4. Heat exchanger 3 adopts a fin-and-tube type structure that has a plurality of plate-like fins and a heat conduction tube penetrating the plurality of fins. It is to be noted that heat exchanger 3 is not limited to a fin-and-tube type heat exchanger. In FIG. 1, a water heating circuit is formed of each component including heat exchanger 3, and pipes 180*a*, 180*b* and 180*c*. Burner 4 and heater 17 correspond to a heater configured to heat the water heating circuit.

Burner 4 is provided for producing combustion gas by combusting a fuel gas. Gas pipe 190 to which gas valve 6 is attached is connected to burner 4. An ignition plug 7 is arranged above burner 4. When ignition plug 7 is operated to generate a spark between targets provided at burner 4, a fuel-air mixture blown out of burner 4 is ignited by the spark and a flame is generated.

Burner 4 combusts fuel gas that is supplied from gas pipe 190 by the above-mentioned spark to generate a quantity of heat (this will be referred to as a "combustion operation"). The quantity of heat generated by the combustion by burner 4 is transmitted through heat exchanger 3 to water flowing through a heat conduction tube of heat exchanger 3, so that the water is heated.

Blower 5 includes, for example, a fan to supply burner 4 with air required for combustion. The fan is configured to be rotatable by being provided with a driving force by fan motor 9.

Water heater body thermistor 8 is arranged such that it can measure the temperature of the fluid delivered from the outlet of heat exchanger 3. Water heater body thermistor 8 is attached to a hot water delivery pipe 180*b* located downstream of heat exchanger 3 or to a heat conduction tube inside heat exchanger 3.

Pipes 180*a*, 180*b*, and 180*c* are pipes for passing the above-mentioned fluid via heat exchanger 3. More specifically, pipes 180*a*, 180*b*, 180*c* correspond to a water supply pipe 180*a*, a hot water delivery pipe 180*b*, and a bypass pipe 180*c*, respectively. Water supply pipe 180*a* is a pipe for supplying fluid (such as water) from a pipe inlet 22A to heat exchanger 3 (more specifically, to the heat conduction tube) and is connected to the water supply side of heat exchanger 3. Hot water delivery pipe 180*b* is a pipe for receiving the fluid that is delivered from heat exchanger 3, and externally delivering the received fluid via a pipe outlet 23A, and is connected to the hot water delivery side of heat exchanger 3. Bypass pipe 180*c* serves to guide fluid including water from water supply pipe 180*a* to hot water delivery pipe 180*b*, and it connects water supply pipe 180*a* and hot water delivery pipe 180*b*. Heater 17 is placed in water supply pipe 180*a* in FIG. 1, but the place where heater 17 is arranged is not limited thereto.

To bypass pipe 180*c*, a bypass flow rate regulating valve 15 is connected. Bypass flow rate regulating valve 15 serves to regulate a flow such as a flow rate of the fluid including water and hot water through bypass pipe 180*c*.

Flow rate sensor 13 is provided downstream of the junction between water supply pipe 180*a* and bypass pipe 180*c*. Flow rate sensor 13 measures an amount of the fluid supplied to heat exchanger 3.

Flow rate regulating valve 14 is provided downstream of the junction between hot water delivery pipe 180*b* and bypass pipe 180*c*. Flow rate regulating valve 14 serves to regulate an amount of a fluid delivered from pipe outlet 23A. Flow rate regulating valve 14, and bypass flow rate regulating valve 15 described above also function as a shutoff valve when they are completely closed. Flow rate regulating valve 14 and bypass flow rate regulating valve 15 are controlled in degree of opening, for example, by a stepping motor.

Display unit 11 is controlled by controller 10 to display information. The displayed information includes: an error indicated when occurrence of clogging with scale is detected; and information about the cleaning mode for scale. The information about the cleaning mode includes information about the time required until the cleaning mode ends. In the present embodiment, an explanation has been given with regard to the case where display unit 11 is mounted in water heating apparatus 20. However, display unit 11 may be mounted in a remote control device capable of remotely operating the water heating apparatus. Further, a speaker generating sound or the like may be employed to output information.

Controller 10 outputs an error to display unit 11 when occurrence of clogging with scale is detected. After the error is output, controller 10 controls each component to prohibit the combustion operation of burner 4. When controller 10 receives an operation for starting a cleaning mode for water heating apparatus 20, controller 10 controls each component to start the cleaning mode for cleaning the inside of heat exchanger 3 with a cleaning liquid.

(Functional Configuration)

Figure 2:
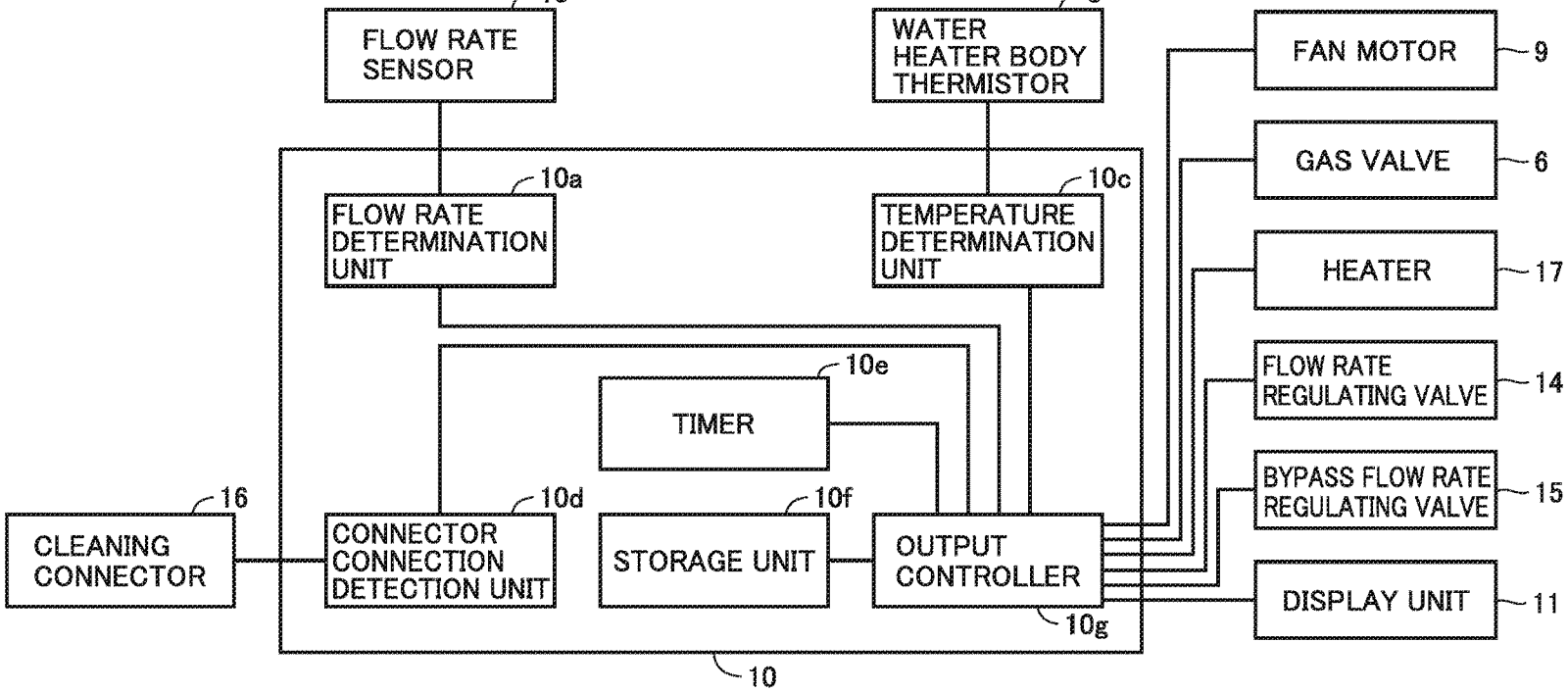
FIG. 2 is a diagram showing an example of the functional configuration of a controller 10 in FIG. 1.

FIG. 2 shows one example of a functional configuration of controller 10. Referring to FIG. 2, controller 10 includes a flow rate determination unit 10*a*, a temperature determination unit 10*c*, a connector connection detection unit 10*d*, a timer 10*e*, a storage unit 10*f*, and an output controller 10*g*.

Flow rate determination unit 10*a* determines a flow rate of the fluid flowing through a pipe, based on an output from flow rate sensor 13. For example, it is determined whether the flow rate detected by flow rate sensor 13 indicates a minimum operation quantity (MOQ) or not. Furthermore, flow rate determination unit 10*a* determines whether the cumulative value of the flow rate measured from the start of the cleaning mode has reached a predetermined threshold value or not.

Temperature determination unit 10*c* determines whether a change in the temperature measured by water heater body thermistor 8 corresponds to a change in the temperature that indicates occurrence of clogging with scale equal to or greater than a predetermined amount in heat exchanger 3.

Connector connection detection unit 10*d* accepts a user operation for water heating apparatus 20. Specifically, connector connection detection unit 10*d* determines whether a cleaning connector 16 (which will be described later) is in a connected state or in a disconnected state (a detached state) by the user operation.

Controller 10 includes an MPU (Micro Processing Unit) (not shown). The MPU includes storage unit 10*f* and timer 10*e*. Storage unit 10*f* includes volatile and non-volatile storage media such as a ROM (Read Only Memory) and a RAM (Random Access Memory). The MPU executes a program stored in storage unit 10*f* to control each component of water heating apparatus 20.

Flow rate determination unit 10*a*, temperature determination unit 10*c*, connector connection detection unit 10*d*, timer 10*e*, and storage unit 10*f* are electrically connected to output controller 10*g*. Based on information from each of flow rate determination unit 10*a*, temperature determination unit 10*c*, connector connection detection unit 10*d*, timer 10*e*, and storage unit 10*f*, output controller 10*g* outputs commands, signals and the like for controlling operations of fan motor 9, gas valve 6, heater 17, flow rate regulating valve 14, bypass flow rate regulating valve 15, display unit 11 and the like.

When a stepping motor rotates according to a drive signal from controller 10, flow rate regulating valve 14 and bypass flow rate regulating valve 15 are controlled such that each valve is variably opened and closed in association with the rotation.

Each component in controller 10 shown in FIG. 2 is implemented by a program executed by the MPU or by a combination of the program and a circuit.

Figure 3:
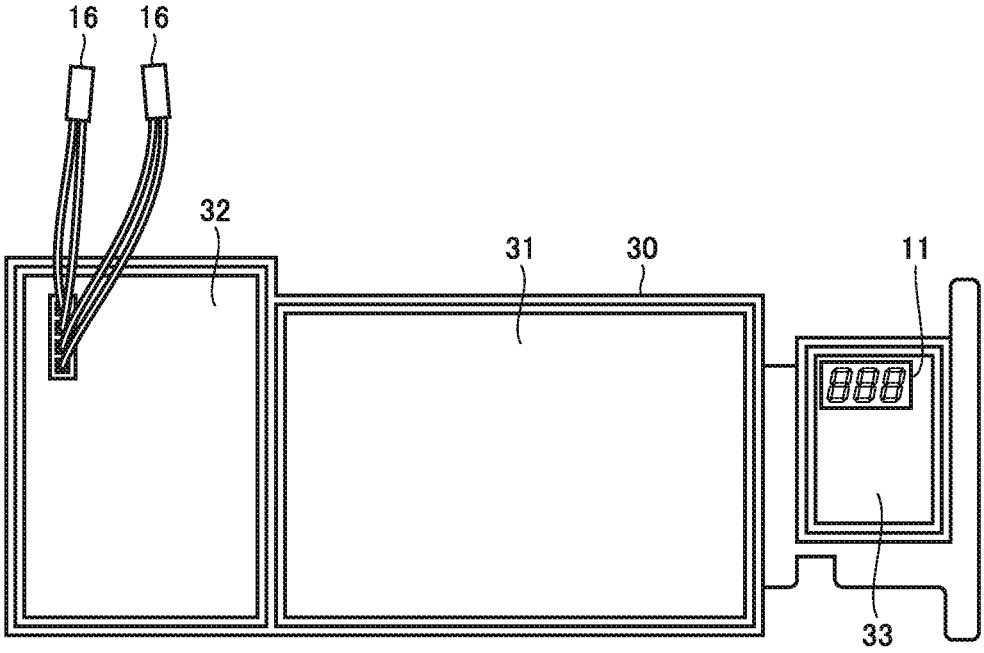
FIG. 3 is a diagram showing an example of a cleaning connector 16 in FIG. 2.

FIG. 3 shows an example of cleaning connector 16 in FIG. 2. With reference to FIG. 3, a controller case 30 is disposed in water heating apparatus 20. In controller case 30, for example, circuit boards 31, 32, and 33 are mounted on which a control circuit of controller 10, a power supply circuit of a power supply unit, and the like are formed. Cleaning connector 16 is connected for example to circuit board 32 to be electrically connected to a circuit formed on circuit boards 31, 32, and 33.

Cleaning connector 16 has a pair of terminals mutually connectable and disconnectable (or removable) by a user operation. When an operation of connection to or disconnection from cleaning connector 16 is done, a signal of the connection or the disconnection is output to a control circuit or the like formed on circuit boards 31, 32. The operation of connecting cleaning connector 16 is set as an operation to start the cleaning mode, and the operation of disconnecting cleaning connector 16 is set as an operation to end the cleaning mode.

(Combustion and Operation Mode)

In the present embodiment, a combustion unit includes burner 4. In the case of stopping (prohibiting) a combustion operation of burner 4, output controller 10*g* controls each component so as to close gas valve 6, stop supplying an electric current to ignition plug 7 (disable ignition), and stop supplying an electric current to fan motor 9 of blower 5 (stop the motor) (which is also referred to as "to implement prohibition of combustion").

In the case of allowing burner 4 to implement combustion, output controller 10*g* controls each component so as to supply an electric current to fan motor 9 (enable motor rotation), open gas valve 6, and pass an electric current to ignition plug 7 (enable ignition) (which is also referred to as "to implement permission for combustion"). When prohibition of combustion is canceled and permission for combustion is implemented, combustion is started. Water heating apparatus 20 includes: a normal mode in which permission for combustion is implemented; and a cleaning mode as modes of operation. In the cleaning mode, prohibition of combustion is basically implemented.

(Cleaning Mode and Water-Passing Mode)

Figure 4:
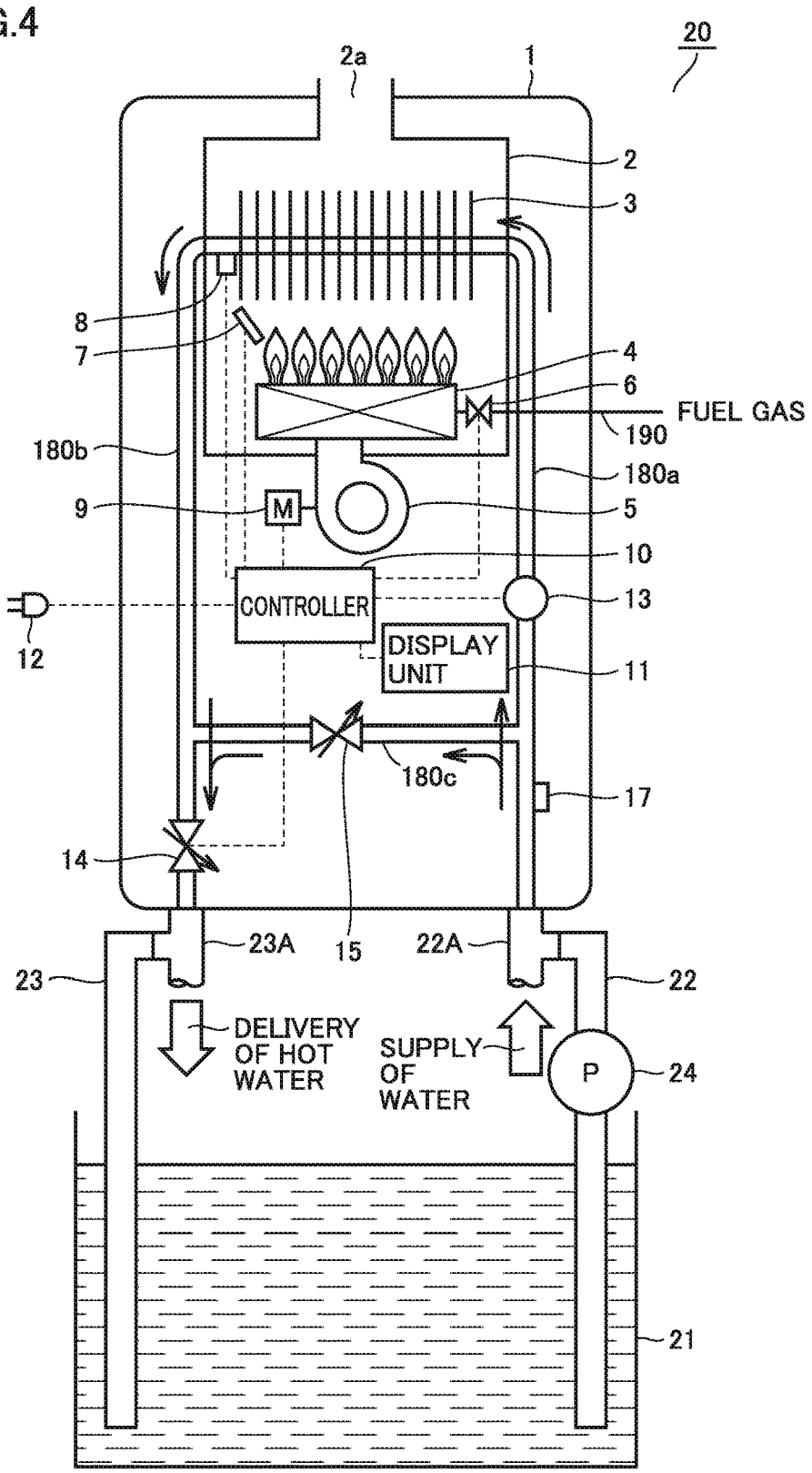
FIG. 4 is a diagram showing a manner of supplying a cleaning liquid to water heating apparatus 20.

When controller 10 starts the cleaning mode, this controller 10 implements cleaning for a predetermined time period. In this case, the predetermined time period is defined as 60 minutes, but is not limited thereto. FIG. 4 shows a manner of supplying a cleaning liquid to water heating apparatus 20 in the cleaning mode. With reference to FIG. 4, tank 21 that stores a cleaning liquid such as acetic acid for removing scale (calcium carbonate) is prepared. One open end of pipe 22 is connected to pipe inlet 22A of water heating apparatus 20 while one open end of pipe 23 is connected to pipe outlet 23A of water heating apparatus 20. Pipes 22 and 23 have their respective other open ends located in the cleaning liquid of tank 21. Further, to pipe 22, a pump 24 is connected for delivering the cleaning liquid in tank 21 to heat exchanger 3 through the pipe.

In the cleaning mode, pump 24 is driven. Thus, the cleaning liquid in tank 21 flows into the pipe through pipe inlet 22A, passes through the inside of water heating apparatus 20 (more specifically, pipes and heat exchanger 3), and is discharged from pipe outlet 23A into tank 21. The cleaning liquid thus circulates through the inside of water heating apparatus 20 via such a route. In order to circulate the cleaning liquid, output controller 10*g* controls flow rate regulating valve 14 so as to be fully opened, and controls bypass flow rate regulating valve 15 so as to be fully closed. Thereby, in the state where bypass pipe 180*c* is shut off, a relatively large amount of cleaning liquid can be supplied intensively to a portion in heat exchanger 3 to which scale is attached.

Furthermore, controller 10 implements a water-passing mode at the end of the cleaning mode. In the water-passing mode, in order to supply clean water such as tap water (hereinafter simply referred to as water) in place of a cleaning liquid to water heating apparatus 20, tank 21 is filled with water in place of a cleaning liquid. In the water-passing mode, pump 24 is driven, so that water inside tank 21 flows into a pipe through pipe inlet 22A, and passes through the pipe and heat exchanger 3. Then, the water is discharged through pipe outlet 23A into tank 21. Water circulates throughout water heating apparatus 20 via such a route. In order to circulate water, output controller 10*g* controls flow rate regulating valve 14 so as to be fully opened and controls bypass flow rate regulating valve 15 so as to be half opened. Thereby, the cleaning liquid remaining in the pipe including bypass pipe 180*c* and in heat exchanger 3 is discharged to the outside together with water.

(Process Flowchart)

Figure 5:
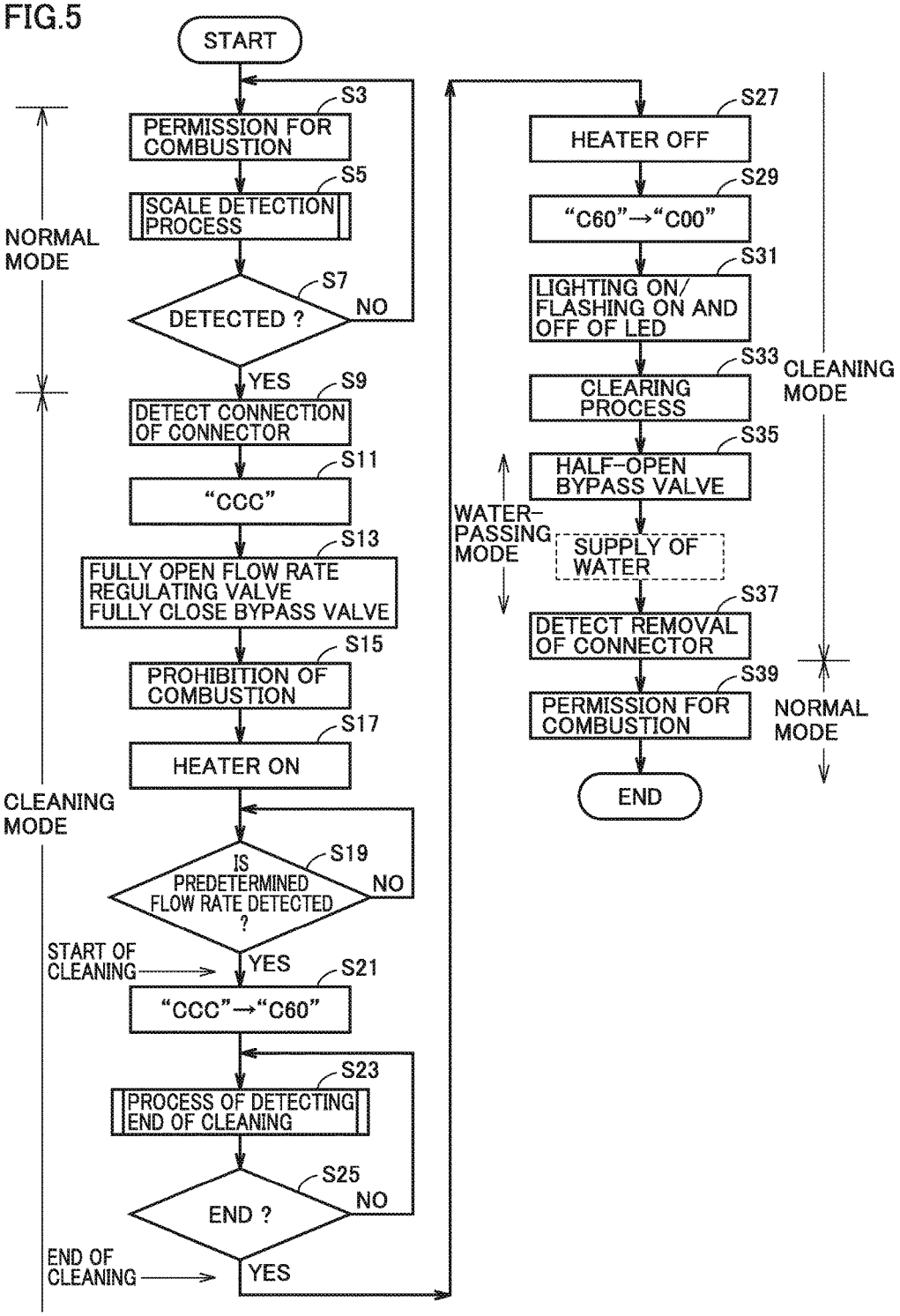
FIG. 5 is a process flowchart according to the first embodiment.

FIG. 5 is a process flowchart according to the first embodiment. The data for the program and the process according to this flowchart is stored in storage unit 10*f* in advance. When the MPU in controller 10 executes the program, the process is implemented.

When power supply plug 12 of water heating apparatus 20 is inserted to a power supply outlet (not shown) to start supplying water heating apparatus 20 with power, the normal mode starts (step S3). In the normal mode, a scale detection process is performed (step S5) while implementing permission for combustion.

In the scale detection process, temperature determination unit 10*c* determines based on the output from water heater body thermistor 8 whether clogging with scale occurs or not. Specifically, temperature determination unit 10*c* compares a threshold value TH with a difference DT between a predetermined temperature and an increased temperature detected by water heater body thermistor 8 after the hot water supply operation is stopped (which will be hereinafter referred to as a post-boiling temperature). When the condition (DT≥TH) is established based on the comparison result, temperature determination unit 10*c* determines that clogging with scale occurs. When the condition is not established, temperature determination unit 10*c* determines that clogging with scale does not occur.

In this case, when scale adheres to the inside of heat exchanger 3, the heat exchange efficiency deteriorates, and the quantity of heat stored in heat exchanger 3 increases. Accordingly, the greater the amount of adhering scale is, the higher the temperature detected by water heater body thermistor 8 is, so that difference DT also becomes larger. Therefore, the condition (DT≥TH) is established when clogging with scale occurs. Thus, in the present process flow, the situation where the condition (DT≥TH) is established is regarded as a situation where water heater body thermistor 8 has detected clogging with scale equal to or greater than a predetermined amount.

When it is determined based on the above-described conditions that clogging with scale does not occur (NO in step S7), the process is returned to step S3. When it is determined based on the above-described conditions that the clogging with scale occurs (YES in step S7), output controller 10*g* causes display unit 11 to display an error. When a user confirms an error, the user connects cleaning connector 16 so as to start cleaning. The user sets water heating apparatus 20 to be in a manner in which a cleaning liquid can be supplied (see FIG. 4).

When connector connection detection unit 10*d* detects based on the output from cleaning connector 16 that the user has connected cleaning connector 16 (step S9), controller 10 changes the operation mode from the normal mode to the cleaning mode.

(Cleaning Mode)

In the cleaning mode, output controller 10*g* causes display unit 11 to display, in place of an error, "CCC" for indicating that the cleaning mode is currently implemented (step S11).

Output controller 10*g* controls flow rate regulating valve 14 so as to be fully opened and controls bypass flow rate regulating valve 15 so as to be fully closed (or set at a minimum opening degree) (step S13). Furthermore, controller 10 implements prohibition of combustion (step S15), and drives heater 17 (step S17).

Thereby, a cleaning liquid can be supplied to heat exchanger 3 while bypass pipe 180*c* is shut off. Also, heat exchanger 3 is supplied with a cleaning liquid heated by heater 17 while the liquid flows through pipe 180.

When pump 24 shown in FIG. 4 is driven, the cleaning liquid is supplied to water heating apparatus 20 through water supply pipe 180*a*. Based on the output from flow rate sensor 13, flow rate determination unit 10*a* determines whether the amount of the cleaning liquid supplied to water heating apparatus 20 has exceeded a predetermined amount or not (step S19). When the predetermined amount is not detected (NO in step S19), the process in step S19 is repeated. The predetermined amount is, for example, 1.0 liter/minute.

On the other hand, when flow rate determination unit 10*a* determines that the supply amount of the cleaning liquid has exceeded the predetermined amount (YES in step S19), output controller 10*g* causes display unit 11 to display "C60" in place of "CCC". By the display of "C60", the user is notified of the start of cleaning and the required time period (60 minutes) for the cleaning.

After displaying "C60" (after the start of cleaning), controller 10 performs a process of detecting the end of cleaning (step S23). For example, controller 10 determines based on the output from timer 10*e* whether the above-described required time period has elapsed since the start of cleaning. When the required time period has not elapsed, controller 10 determines that the cleaning is currently performed (NO in step S25), and returns the process to step S23.

When the required time period has elapsed, controller 10 determines that the cleaning has ended (YES in step S25). When the cleaning ends, output controller 10*g* stops (turns off) heater 17 (step S27) and causes display unit 11 to display "C00" in place of "C60" (step S29). Furthermore, output controller 10*g* controls a light emitting diode (LED) (not shown) to light on/flash on and off (step S31). By displaying "C00" and controlling the LED to light on/flash on and off, the user is notified of the end of cleaning. Furthermore, controller 10 clears a counter and the like used for counting the required time period (step S33).

When the user confirms the end of the cleaning mode (confirms that the cleaning mode has ended) based on the display of "C00" and lighting on/flashing on and off of the LED, tank 21 in FIG. 4 is filled with water in place of a cleaning liquid for causing water to pass therethrough.

When the cleaning ends, output controller 10*g* controls the fully-closed bypass flow rate regulating valve 15 to be half opened while flow rate regulating valve 14 is kept fully opened (step S35). Then, controller 10 implements a water-passing mode.

In the water-passing mode, pump 24 is driven for a predetermined time period. Thereby, the water in tank 21 passes through pipes (water supply pipe 180*a*, hot water delivery pipe 180*b* and bypass pipe 180*c*) and heat exchanger 3. Consequently, the cleaning liquid remaining in the pipes and heat exchanger 3 is discharged together with water through hot water delivery pipe 180*b* to the outside. Also, since bypass flow rate regulating valve 15 is half-opened, the amount of the water flowing into heat exchanger 3 can be increased while suppressing inflow of water into bypass pipe 180*c*. Consequently, the cleaning liquid remaining in heat exchanger 3 and bypass pipe 180*c* can be effectively discharged.

When the predetermined time period has elapsed since the start of the water-passing mode, output controller 10*g* causes display unit 11 to display the information indicating the end of the water-passing mode (indicating that the water-passing mode has ended). Alternatively, the above-described LED is turned on. Thereby, the user is notified of the end of the water-passing mode. In addition, the end of the water-passing mode is determined based on a time period, but the determination method is not limited thereto. For example, the flow rate accumulated from the output of flow rate sensor 13 is calculated to obtain a cumulative flow rate. Then, when the cumulative flow rate becomes equal to or greater than a predetermined flow rate, the end of the water-passing mode may be determined.

When the user confirms the end of the water-passing mode, the user stops pump 24 and performs an operation for removing cleaning connector 16. When connector connection detection unit 10*d* detects based on the output of cleaning connector 16 that cleaning connector 16 has been removed (step S37), controller 10 implements permission for combustion (step S39). Thereby, the operation mode of water heating apparatus 20 is changed from the cleaning mode to the original normal mode.

In the first embodiment, in the cleaning mode, the cleaning liquid is warmed by heater 17 while it passes through pipe 180, and then supplied to heat exchanger 3. Therefore, the neutralization rate between acetic acid and the like in the warmed cleaning liquid and the scale can be raised, so that the cleaning efficiency can be improved. Also, the time required for removing scale can be shortened. Furthermore, cleaning can be done with a relatively small amount of cleaning liquid. Thereby, it becomes possible to shorten the time for the user to perform the cleaning operation, and to lengthen the time during which water heating apparatus 20 can perform a hot water supply operation.

In addition, burner 4 may be used in place of heater 17 or in combination with heater 17 in order to warm the inside of water heating apparatus 20.

In the first embodiment, connection of cleaning connector 16 is defined as an operation of starting the cleaning mode, and removal of cleaning connector 16 is defined as an operation of ending the cleaning mode, but the starting operation may be defined as "removal" and the ending operation may be defined as "connection".

(First Modification)

In the first embodiment, output controller 10*g* controls bypass flow rate regulating valve 15 to be fully closed (or set at a minimum opening degree) in the cleaning mode, and controls this bypass flow rate regulating valve 15 to be half-opened in the water-passing mode implemented when the cleaning mode is ended, but the opening degree is not limited thereto. In other words, output controller 10*g* may control bypass flow rate regulating valve 15 to be set at an opening degree such that the flow rate of the water in bypass pipe 180*c* in the water-passing mode is greater than the flow rate of the cleaning liquid in bypass pipe 180*c* in the cleaning mode. Even in such a case, in the water-passing mode, the remaining cleaning liquid can be effectively discharged to the outside.

(Second Modification)

Figure 6:
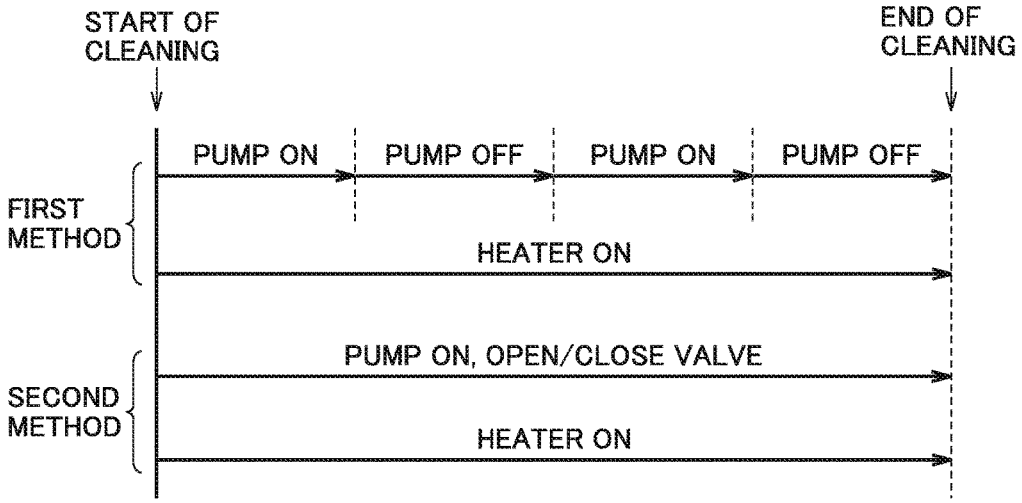
FIG. 6 is a diagram showing an example of a cleaning method performed in a cleaning mode in FIG. 5.

FIG. 6 is a diagram showing an example of a cleaning method in the cleaning mode. FIG. 6 shows the first method and the second method as cleaning methods. Referring to FIG. 6, according to the first method, the user drives pump 24 so as to be intermittently ON and OFF while heating the pipe with heater 17. Thereby, the heated cleaning liquid is intermittently supplied into water heating apparatus 20. According to the second method, when pump 24 is continuously driven while the pipe is heated with heater 17, output controller 10*g* controls flow rate regulating valve 14 so as to be repeatedly fully opened and fully closed. According to each of the above-described methods, the cleaning liquid is to wave inside heat exchanger 3, so that the adhering scale can be peeled off and removed.

Second Embodiment

In the present second embodiment, a modification of the process of detecting the end of cleaning (step S23) in the first embodiment will be described.

In the process of detecting the end of cleaning in the first embodiment, controller 10 determines the end of cleaning (that the cleaning has ended) based on the time period (60 minutes). In the present embodiment, however, controller 10 determines the end of the cleaning based on the amount of the cleaning liquid supplied to water heating apparatus 20.

According to the first method, the end of cleaning is determined based on the cumulative flow rate of the cleaning liquid. Specifically, flow rate determination unit 10*a* accumulates, from the start of the cleaning mode, the flow rate (supply amount) of the cleaning liquid inside water heating apparatus 20 based on the output from flow rate sensor 13 (liter/minute). When flow rate determination unit 10*a* determines that the cumulative value has reached the first threshold value showing a predetermined flow rate, this flow rate determination unit 10*a* determines the end of cleaning. In addition, the first threshold value indicates a predetermined flow rate of the cleaning liquid for cleaning away the scale. The first threshold value is a value obtained by experiments and the like and stored in storage unit 10*f*.

According to the second method, the end of cleaning is determined based on the combination of the amount of cleaning liquid and the time period. Specifically, once cleaning is started, flow rate determination unit 10*a* adds a value to the counter of the timer when the output from flow rate sensor 13 exceeds a predetermined value (for example, 1.0 liter/minute), but does not add a value to the counter when the output from flow rate sensor 13 is equal to or less than the predetermined value. Thus, when the number of times that the output from flow rate sensor 13 has exceeded the predetermined value reaches for examples 60, flow rate determination unit 10*a* determines the end of cleaning. In addition, this predetermined value is a value obtained by experiments and the like and stored in storage unit 10*f*.

Third Embodiment

Figure 7:
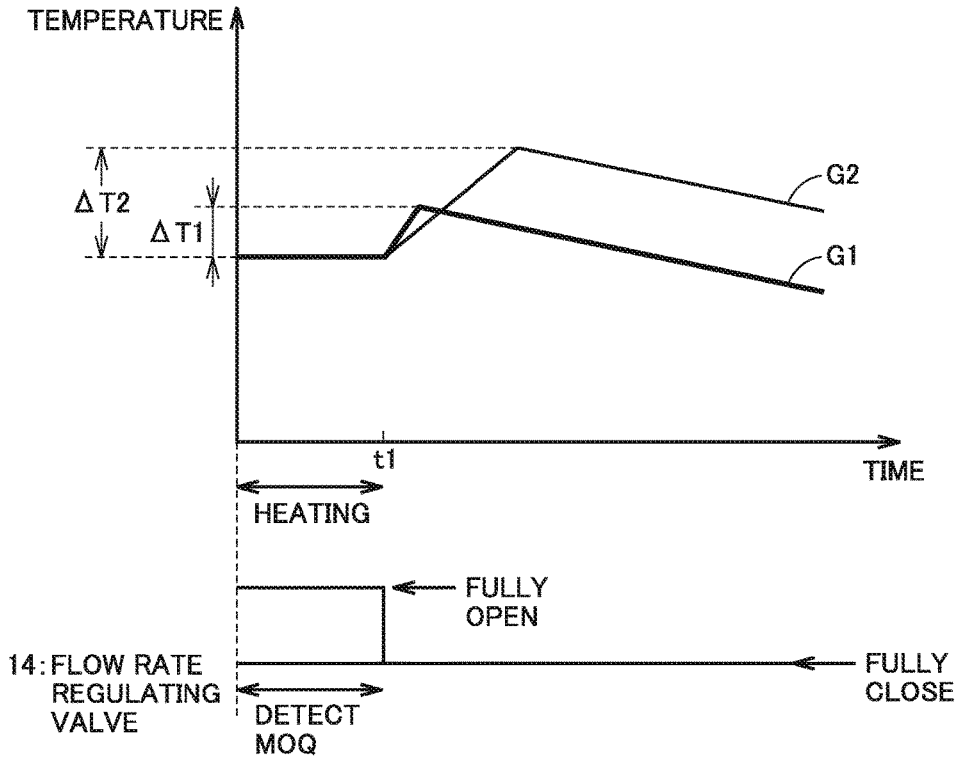
FIG. 7 is a graph schematically showing a method of determining an end of cleaning according to the third embodiment.

In the present third embodiment, still another modification of the process of detecting the end of cleaning (step S23) in the first embodiment will be described. FIG. 7 shows a graph schematically showing a method of determining the end of cleaning according to the present third embodiment. In the graph in FIG. 7, the vertical axis shows a temperature detected by water heater body thermistor 8 while the horizontal axis shows an elapsed time.

In the third embodiment, while the cleaning mode is implemented, controller 10 detects the degree of scale removal based on the post-boiling temperature, and determines the end of cleaning based on the detection result. When a relatively large amount of scale adheres to heat exchanger 3, the post-boiling temperature is relatively high as described above. In the third embodiment, temperature determination unit 10*c* functions also as a temperature determination unit for determining whether the post-boiling temperature detected by water heater body thermistor 8 is less than the temperature of threshold value TH or not.

In the cleaning mode, controller 10 implements the combustion operation by burner 4 in the state where the minimum operation quantity (MOQ) is detected from the output of flow rate sensor 13 by flow rate determination unit 10*a*. The combustion operation is stopped when time t1 has elapsed since the start of the combustion operation.

Based on the output from water heater body thermistor 8 obtained after the combustion operation is stopped, temperature determination unit 10*c* calculates a post-boiling temperature ΔT, and determines whether the calculated post-boiling temperature ΔT is less than threshold value TH or not. When the condition of (ΔT<TH) is established, temperature determination unit 10*c* determines that clogging with scale does not occur. When the condition of (ΔT<TH) is not established, temperature determination unit 10*c* determines that clogging with scale occurs.

For example, when the output from water heater body thermistor 8 changes as shown in a graph G1 in FIG. 7 after stopping the combustion operation described above, temperature determination unit 10*c* detects a post-boiling temperature ΔT1. Then, because the condition of (ΔT1<TH) is established for the detected ΔT1, temperature determination unit 10*c* determines that clogging with scale does not occur. In contrast, when the output from water heater body thermistor 8 changes as shown in a graph G2 in FIG. 7 after stopping the combustion operation, temperature determination unit 10*c* detects a post-boiling temperature ΔT2. Then, because the condition of (ΔT2<TH) is not established for the detected ΔT2, temperature determination unit 10*c* determines that clogging with scale occurs. Thus, regarding the post-boiling temperature, the end of cleaning is not determined when a change in graph G2 is detected, but the end of cleaning is determined when a change in graph G1 is detected.

According to the third embodiment, unlike the first embodiment, it can be determined that the cleaning has ended without having to wait a lapse of 60 minutes on every occasion. Therefore, the time period for the cleaning mode can be shortened. Furthermore, in the third embodiment, heating is implemented by burner 4 in the state where the MOQ is detected, so that heat exchanger 3 can be prevented from being excessively heated by burner 4 and being damaged thereby.

In addition, the above-described first to third embodiments can be implemented in combination as appropriate.

Fourth Embodiment

The fourth embodiment shows a modification of each of the above-described embodiments. The present fourth embodiment provides a method of implementing a cleaning mode in a water heating system 110 including: a plurality of coupled water heating apparatuses 20 (hereinafter also referred to as a multi-coupled-type water heater) and a controller for controlling the plurality of water heating apparatuses 20.

Figure 8:
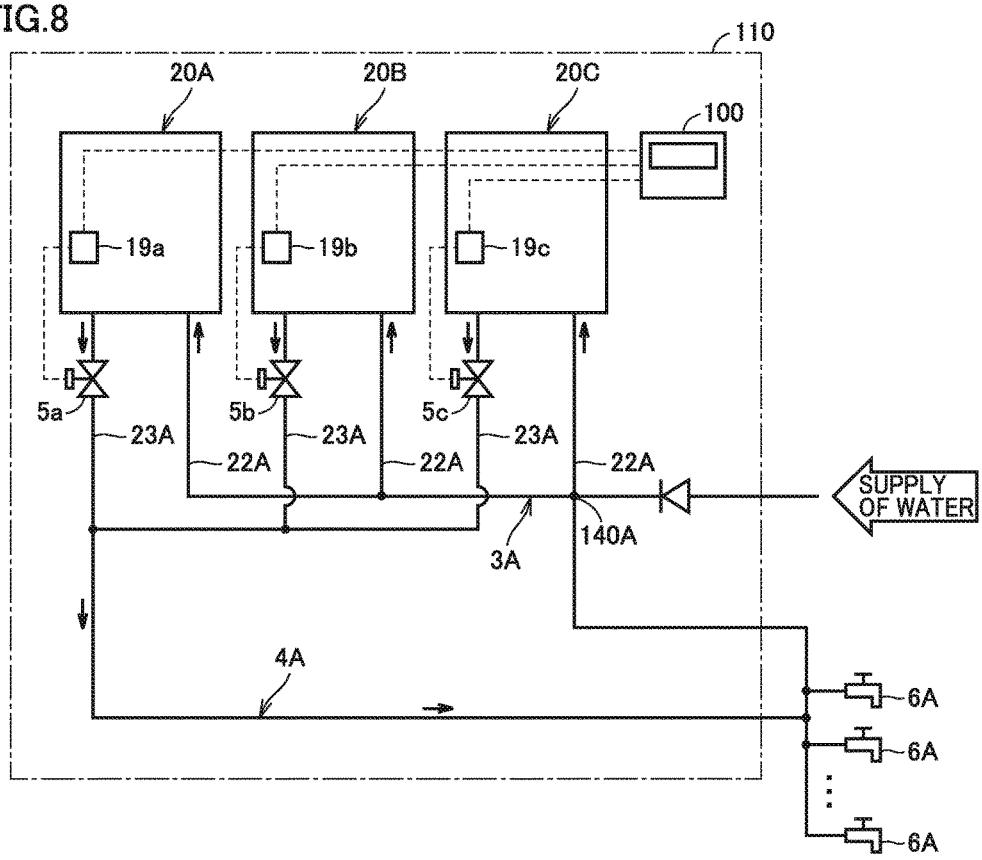
FIG. 8 shows a water heating system 110 according to the fourth embodiment.

FIG. 8 shows a water heating system 110 according to the fourth embodiment. Water heating system 110 includes a multi-coupled-type water heater and a controller 100 for controlling the multi-coupled-type water heater. The multi-coupled-type water heater includes a plurality of water heating apparatuses 20A, 20B and 20C coupled via a common hot water supply path. Water heating system 110 further includes a water supply pipe 3A for supplying water to each of pipe inlets 22A of water heating apparatuses 20A, 20B and 20C, and a hot water supply pipe 4A for delivering hot water from water heating apparatuses 20A, 20B and 20C to an external hot water tap (hot water supply faucet) 6A. Hot water supply pipe 4A is connected to each of pipe outlets 23A of water heating apparatuses 20A, 20B, 20C via electromagnetically opened/closed valves 5*a*, 5*b*, and 5*c*, respectively. When hot water tap 6A is opened, hot water from each water heating apparatus is delivered from hot water tap 6A via hot water supply pipe 4A.

Valves 5*a*, 5*b*, and 5*c* are opened/closed as controlled by controller 100. Opening valves 5*a*, 5*b*, 5*c* allows water to be supplied from water supply pipe 3A to the respective water heating apparatuses and to be output from the respective water heating apparatuses to hot water supply pipe 4A.

Water heating apparatuses 20A, 20B, and 20C include controllers 19*a*, 19*b*, and 19*c*, respectively, configured to control their respective water heating apparatuses. Each of controllers 19*a*, 19*b*, and 19*c* communicates with controller 100 via a communication cable. Each of water heating apparatuses 20A, 20B, and 20C receives a command from controller 100, and performs an operation according to the received command. Hereinafter, when water heating apparatuses 20A, 20B, and 20C are collectively referred to, they will be referred to as water heating apparatus 20. Furthermore, when controllers 19*a*, 19*b*, and 19*c* are collectively referred to, they will be referred to as controller 19. Although the multi-coupling type water heater is configured of three water heating apparatuses 20 in FIG. 8, the number of water heating apparatuses is not limited to three and any number thereof that is more than one can be used. Each of water heating apparatuses 20A, 20B, 20C has a basic hardware configuration and a configuration and operation in the cleaning mode that are similar to those having been illustrated in FIGS. 1, 4 and 5, and accordingly, the detailed description thereof will not be repeated.

Figure 9:
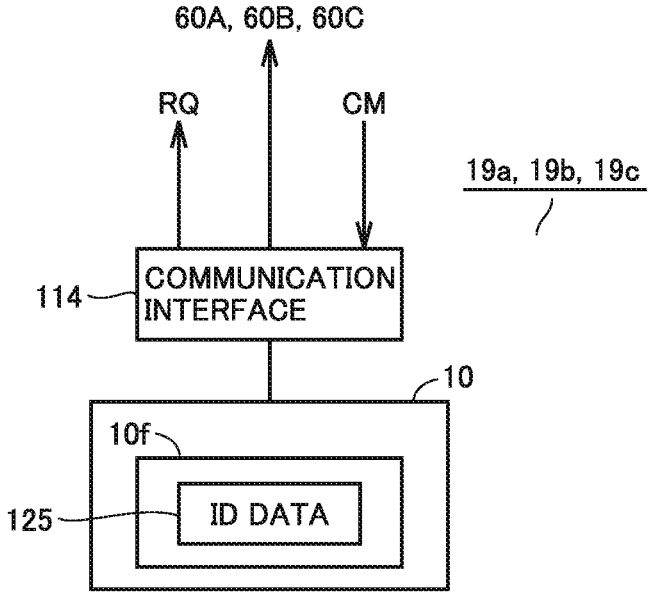
FIG. 9 is a diagram showing the configuration of a controller 19 according to the fourth embodiment.

FIG. 9 is a diagram showing the configuration of a controller 19 according to the fourth embodiment. Controller 19 includes controller 10 and the like in FIG. 3, and in addition, a communication interface 114 for communicating with controller 100. Storage unit 10*f* stores ID data 125 for identifying water heating apparatus 20. Communication interface 114 receives a complement request RQ from controller 10 and transmits it to controller 100, and also receives an operation start command CM from controller 100. Complement request RQ indicates a request for a water heating apparatus to complement its hot water supply capability when it operates. Complement request RQ includes ID data 125 of water heating apparatus 20 as a sender. Furthermore, communication interface 114 transmits, to controller 100, a mode start notification 60A, a flow rate notification 60B, and a mode end notification 60C each for the cleaning mode that are output from controller 10.

Figure 10:
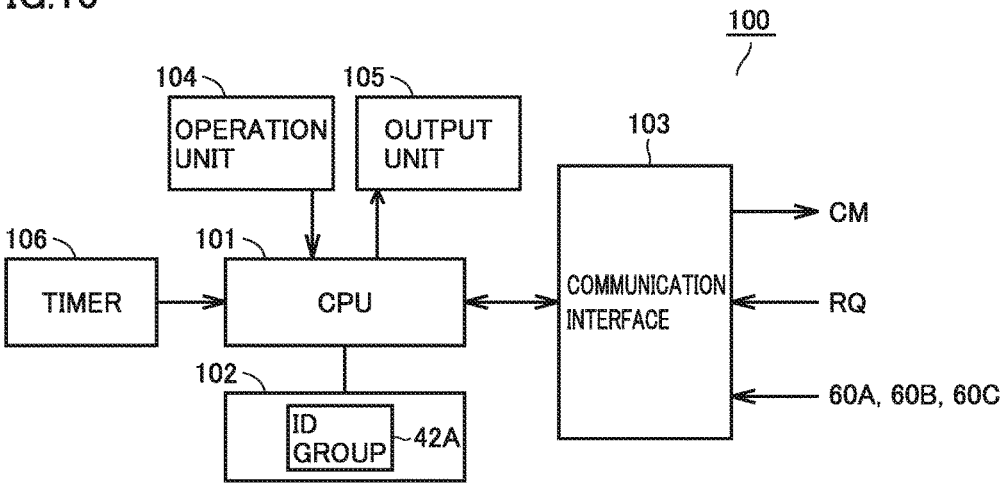
FIG. 10 is a diagram showing the configuration of a controller 100 according to the fourth embodiment.

FIG. 10 is a diagram showing the configuration of controller 100 according to the fourth embodiment. Controller 100 includes a CPU (a central processing unit) 101, a storage unit 102, a communication interface 103 for communicating with each water heating apparatus 20, an operation unit 104 for receiving a user operation, an output unit 105 for outputting information regarding an operation of the entire multi-coupled-type water heater or an operation of each water heating apparatus 20, and a timer 106. Output unit 105 includes a display which displays an image, or an audio device which outputs sound, or the like. Communication interface 103 receives a command from CPU 101 and transmits it to each water heating apparatus 20, and also receives complement request RQ, mode start notification 60A, flow rate notification 60B, and mode end notification 60C from each water heating apparatus 20.

Storage unit 102 has a region for storing an ID group 42A including one or more pieces of ID data 125 for water heating apparatus 20 that is operated in the cleaning mode. When CPU 101 receives complement request RQ, this CPU 101 determines ID data 125 for water heating apparatus 20 operated in the cleaning mode based on ID group 42A. Then, CPU 101 does not transmit operation start command CM to water heating apparatus 20 that has been determined. This is referred to as "separation". By this separation, controller 100 can extract a water heating apparatus 20 currently implementing the cleaning mode in water heating system 110, and can transmit operation start command CM to water heating apparatuses 20 other than the extracted water heating apparatus 20, that is, only to a water heating apparatus operated in the normal mode.

When the multi-coupled-type water heater starts a hot water supply operation, controller 100 controls one of the plurality of water heating apparatuses 20 as a main water heating apparatus serving to start the operation, and controls the other water heating apparatus(es) 20 as a subordinate water heating apparatus(es). When controller 100 receives complement request RQ from the main water heating apparatus, controller 100 transmits operation start command CM to a sub water heating apparatus. In response to operation start command CM, the sub water heating apparatus starts an operation.

Figure 11:
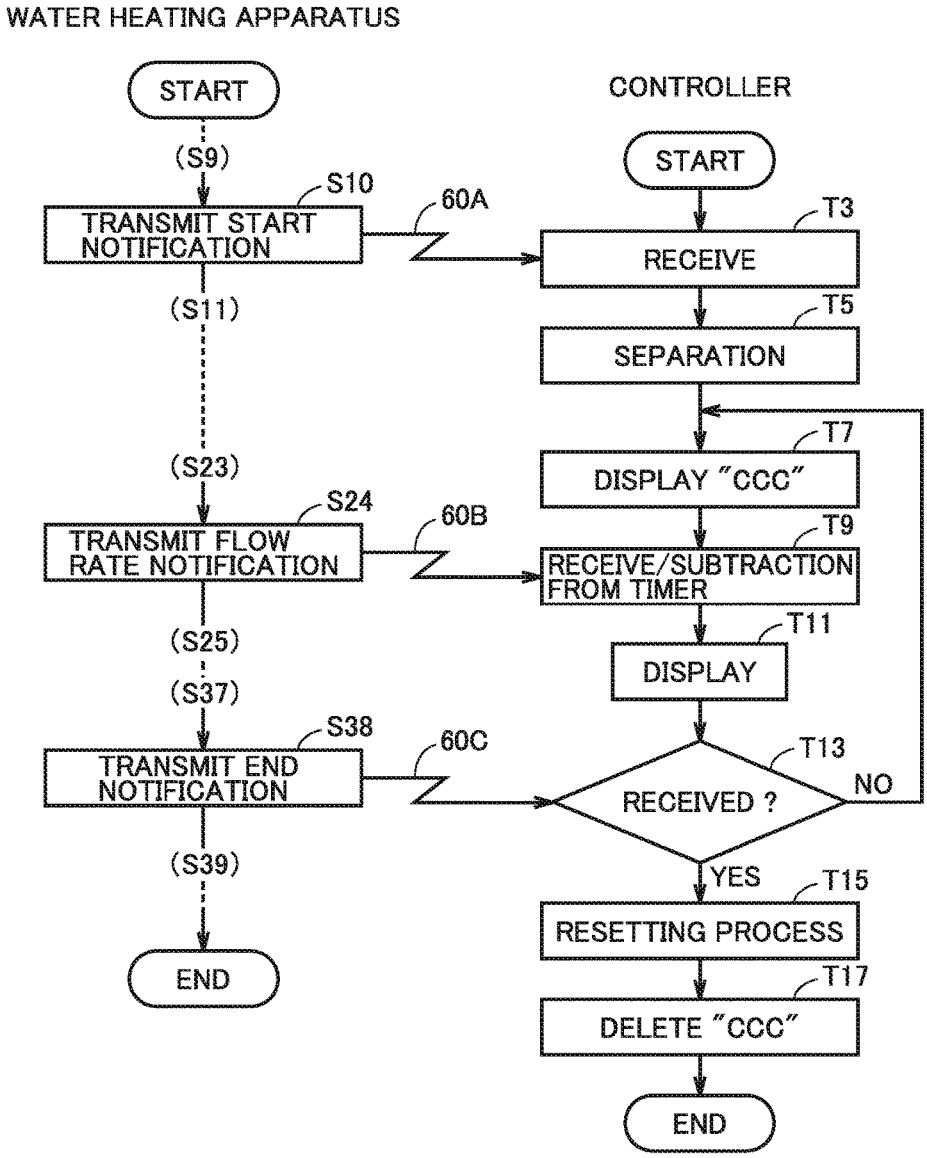
FIG. 11 is a diagram showing a process flow for controller 100 and a water heating apparatus 20 in the cleaning mode according to the fourth embodiment.

The operation in the cleaning mode in water heating system in FIG. 8 will be hereinafter described with reference to FIGS. 11 and 12. FIG. 11 is a diagram showing a process flow of controller 100 and water heating apparatus 20 in the cleaning mode according to the fourth embodiment. The program according to the process flow in FIG. 11 is stored in each of storage unit 102 of controller 100 and storage unit 10*f* of water heating apparatus 20. When CPU 101 executes the program in storage unit 102 and when the MPU in controller 10 executes the program, the process is implemented. In addition, the process on the water heating apparatus 20 side in the present embodiment is a process in FIG. 5 additionally including steps S10, S24 and S38. The process for water heating apparatus 20 in FIG. 11 shows only these additional steps. Since other processes for water heating apparatus 20 in FIG. 11 are the same as those in FIG. 5, the detailed description thereof will not be repeated.

In the present embodiment, when water heating apparatus 20 shifts to a cleaning mode (see step S9 in FIG. 5), water heating apparatus 20 transmits, to controller 100, mode start notification 60A indicating start of the cleaning mode (indicating that the cleaning mode has started) (step S10). When the cleaning mode ends (see step S37 in FIG. 5), water heating apparatus 20 transmits, to controller 100, mode end notification 60C indicating end of the cleaning mode (indicating that the cleaning mode has ended) (step S38). Also, in the cleaning mode, water heating apparatus 20 transmits flow rate notification 60B to controller 100 each time flow rate sensor 13 detects a prescribed flow rate (1 liter/minute) (step S24). Each of mode start notification 60A, flow rate notification 60B and mode end notification 60C includes ID data 125 of this water heating apparatus 20.

Referring to FIG. 11, an explanation will be hereinafter given with regard to the process performed when one of water heating apparatuses 20 in FIG. 10 shifts to a cleaning mode. CPU 101 in controller 100 receives mode start notification 60A from water heating apparatus 20 through communication interface 103 (step T3). CPU 101 records, in ID group 42A of storage unit 102, ID data 125 included in the received mode start notification 60A. Then, when CPU 101 receives complement request RQ, this CPU 101 implements separation of water heating apparatus 20 currently implementing the cleaning mode (step T5) based on ID group 42A.

Furthermore, CPU 101 causes output unit 105 to display "CCC" in order to notify that the cleaning mode of water heating apparatus 20 has been started (step T7).

Each time CPU 101 in controller 100 receives flow rate notification 60B from water heating apparatus 20, this CPU 101 subtracts (decrements) a value from the counter corresponding to a timer that counts the required time period (60 minutes) for the cleaning mode (step T9). Thereby, during reception of flow rate notification 60B, the value of the counter changes, for example, 60→59→ . . . →01→00. CPU 101 causes output unit 105 to display an initial value (60) of the counter in step T7. After that, CPU 101 causes output unit 105 to display a value of the counter obtained after subtraction during reception of flow rate notification 60B (step T11).

While CPU 101 does not receive mode end notification 60C from water heating apparatus 20 (NO in step T13), CPU 101 returns the process to step T7. However, when CPU 101 receives mode end notification 60C (YES in step T13), the resetting process is implemented (step T15). Then, CPU 101 causes output unit 105 to end (delete) the display of "CCC" (step T17).

In the above-described resetting process, CPU 101 deletes ID data 125 included in mode end notification 60C from ID group 42A in storage unit 102. This subsequently allows cancellation of the "separation" state of water heating apparatus 20 as a sender of mode end notification 60C. Thereby, water heating apparatus 20 is reset back to a target to which operation start command CM is transmitted after the end of the cleaning mode.

(Example of Display)

In the fourth embodiment, controller 100 outputs (display), through output unit 105, data for giving a notification about implementation of the cleaning mode.

When controller 100 receives mode start notification 60A from one or more of the plurality of water heating apparatuses 20 in water heating system 110, controller 100 outputs, through output unit 105, notification data (for example, "CCC") for giving a notification about implementation of the cleaning mode. Then, when controller 100 receives mode end notification 60C from all of water heating apparatuses 20 that have transmitted mode start notification 60A, controller 100 ends (deletes) the output of the notification data.

Figure 12:
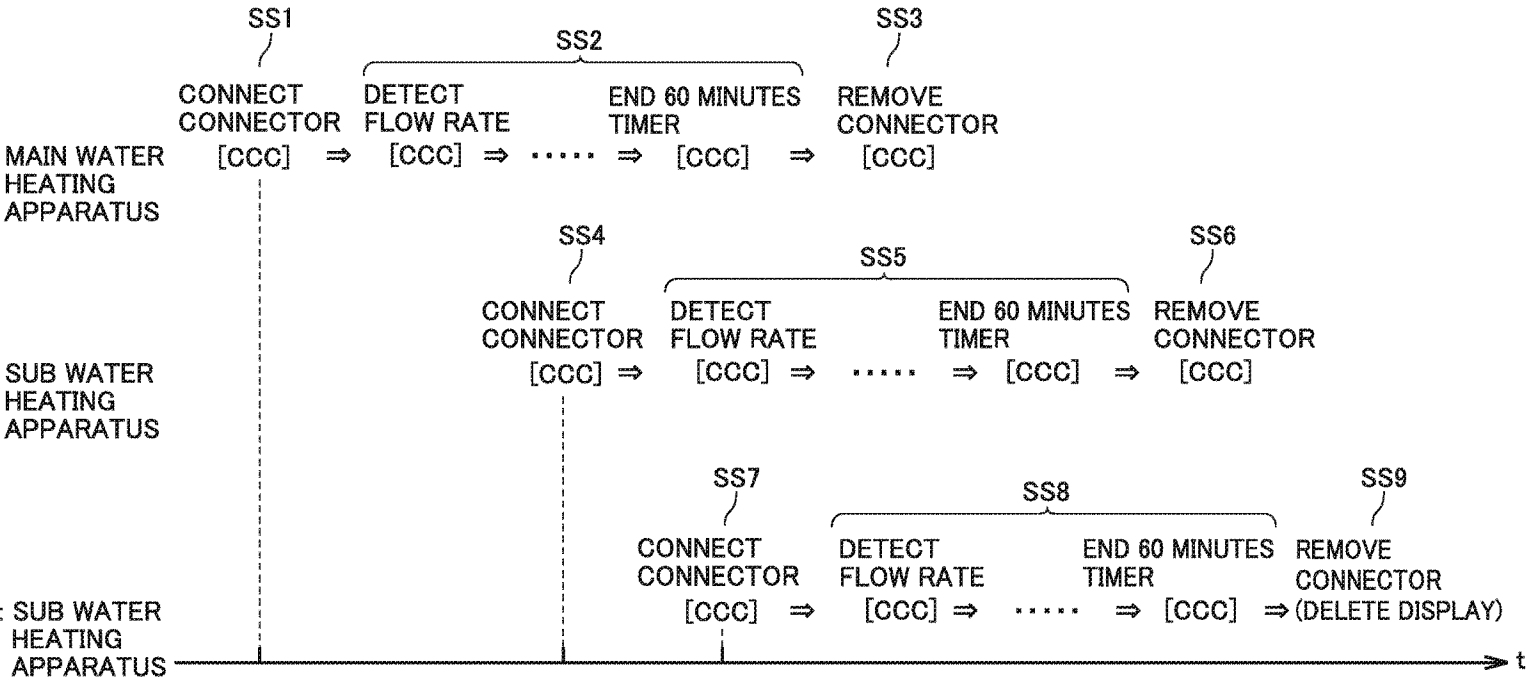
FIG. 12 is a diagram showing an example of display in the cleaning mode according to the fourth embodiment.

FIG. 12 is a diagram showing an example of display in the cleaning mode according to the fourth embodiment. In FIG. 12, a change of the information displayed on output unit 105 that occurs according to the progress of time t is shown in association with the operation mode of each of water heating apparatuses 20A, 20B and 20C.

As shown in FIG. 12, the operation mode of water heating apparatus 20A as a main water heating apparatus first shifts to a cleaning mode. Then, while water heating apparatus 20A is in the cleaning mode, the operation mode of water heating apparatus 20B as a sub water heating apparatus shifts to a cleaning mode. Then, while water heating apparatus 20B is in the cleaning mode, the operation mode of water heating apparatus 20C shifts to a cleaning mode, which will be hereinafter specifically explained.

Referring to FIG. 12, when CPU 101 in controller 100 first receives mode start notification 60A from water heating apparatus 20A, this CPU 101 causes output unit 105 to display "CCC" indicating implementation of the cleaning mode (step SS1). Then, also during reception of flow rate notification 60B from water heating apparatus 20A (step SS2), CPU 101 causes output unit 105 to continuously display "CCC". Then, also when CPU 101 receives mode end notification 60C from water heating apparatus 20A, this CPU 101 causes output unit 105 to keep displaying "CCC" (step SS3). Namely, when CPU 101 receives mode start notification 60A from water heating apparatus 20B (step SS4) during reception of flow rate notification 60B from water heating apparatus 20A, this CPU 101 causes output unit 105 to keep displaying "CCC" even if it receives mode end notification 60C from water heating apparatus 20A (step SS6).

After that, similarly, CPU 101 receives mode start notification 60A from water heating apparatus 20C (step SS7). Then, even if CPU 101 receives mode end notification 60C from water heating apparatus 20B (step SS6) during reception of flow rate notification 60B (step SS8), this CPU 101 causes output unit 105 to keep displaying "CCC" (step SS8).

Then, when CPU 101 receives mode end notification 60C from water heating apparatus 20C (step SS9), this CPU 101 causes output unit 105 to delete the display of "CCC" (step SS9). In other words, in the case where CPU 101 does not receive mode start notification 60A from another water heating apparatus 20 during reception of flow rate notification 60B from water heating apparatus 20C (step SS8), this CPU 101 causes output unit 105 to end (delete) the display of "CCC" when it receives mode end notification 60C.

In this way, in the case where the cleaning mode is implemented in each water heating apparatus 20 in the coupled-type water heater, controller 100 causes output unit 105 to start to display "CCC" when it receives mode start notification 60A. Then, controller 100 keeps displaying "CCC" until it determines that mode end notification 60C has been received from all of water heating apparatuses 20 as destinations of mode start notification 60A. Thereby, when each water heating apparatus 20 in a multi-coupled-type water heater is cleaned, it is notified that implementation of the cleaning mode has been started, that the cleaning mode is currently implemented, and that implementation of the cleaning mode for all of water heating apparatuses 20 has been ended.

(Modification of Display)

In FIG. 12, controller 100 displays only "CCC" as data for notifying that the cleaning mode is currently implemented, but the notification data is not limited thereto. For example, together with "CCC" or separately from "CCC", controller 100 may display an identifier of water heating apparatus 20 specified by ID data 125 of flow rate notification 60B that has been received from each water heating apparatus 20.

Furthermore, the notification data may include data that changes so as to show a progress from the start to the end of the cleaning mode. In this case, flow rate notification 60B includes a value of the counter that counts the required time period of the cleaning mode (see step T9 in FIG. 11).

The data that changes as described above includes data that changes so as to show a progress of the time in the cleaning mode. Specifically, controller 100 causes output unit 105 to display the value of the counter included in flow rate notification 60B each time it receives flow rate notification 60B from water heating apparatus 20. Thereby, it becomes possible to display the data that changes so as to show the above-described progress of time (for example, the data that changes sequentially C60→C59→ . . . C00). In addition, when the data that changes so as to show a progress is displayed, the data may be output together with the above-described "CCC" or with the identifier of water heating apparatus 20, or may be displayed separately therefrom.

Furthermore, each time controller 100 receives mode start notification 60A from water heating apparatus 20, this controller 100 causes output unit 105 to stop changing of the data that shows the above-described progress of time, and causes output unit 105 to display the value of the counter included in flow rate notification 60B that has been received from water heating apparatus 20. Thereby, each time controller 100 receives mode start notification 60A from water heating apparatus 20, this controller 100 can stop changing of the data, in the middle thereof, showing the progress of time on output unit 105 and can again start to display the data that changes so as to show the progress of time for the cleaning mode of water heating apparatus 20.

According to the present embodiment, when controller 100 receives mode start notification 60A, this controller 100 implements separation to thereby exclude water heating apparatus 20 as a sender of this notification from a target for which the hot water supply operation is to be controlled. Then, when controller 100 receives mode end notification 60C from water heating apparatus 20, it performs a resetting process to reset this water heating apparatus 20 back to a target for which the hot water supply operation is to be controlled. Thereby, the cleaning mode of water heating apparatus 20 can be implemented in the state where water heating apparatus 20 is connected to a communication cable with controller 100.

Furthermore, when the cleaning mode is implemented in a plurality of water heating apparatuses 20 of a multi-coupled-type water heater, it becomes possible to notify that the cleaning mode is currently implemented until the end of the cleaning mode for all of water heating apparatus 20. Also, each water heating apparatus 20 notifies that each water heating apparatuses 20 currently implements the cleaning mode by the output from display unit 11 or by lighting on/flashing on and off of the LED. Thereby, the user can confirm in which water heating apparatus 20 the cleaning mode is being implemented.

Furthermore, in each water heating apparatus 20, the value of the counter that counts the remaining time of the cleaning mode is output as data that changes in time series so as to show the progress of the cleaning mode. Thereby, the remaining time can be notified during implementation of the cleaning mode for each water heating apparatus 20. In addition, the data that changes in time series so as to show the progress of the cleaning mode may be a value obtained by controller 10 accumulating the flow rate based on the output of flow rate sensor 13 from the start of the cleaning mode (a value obtained by accumulating the flow rate of the cleaning liquid flowing through heat exchanger 3). The data showing changes in the cumulative flow rate may be output together with the data showing the above-described progress of time or may be output separately therefrom.

Fifth Embodiment

Figure 13:
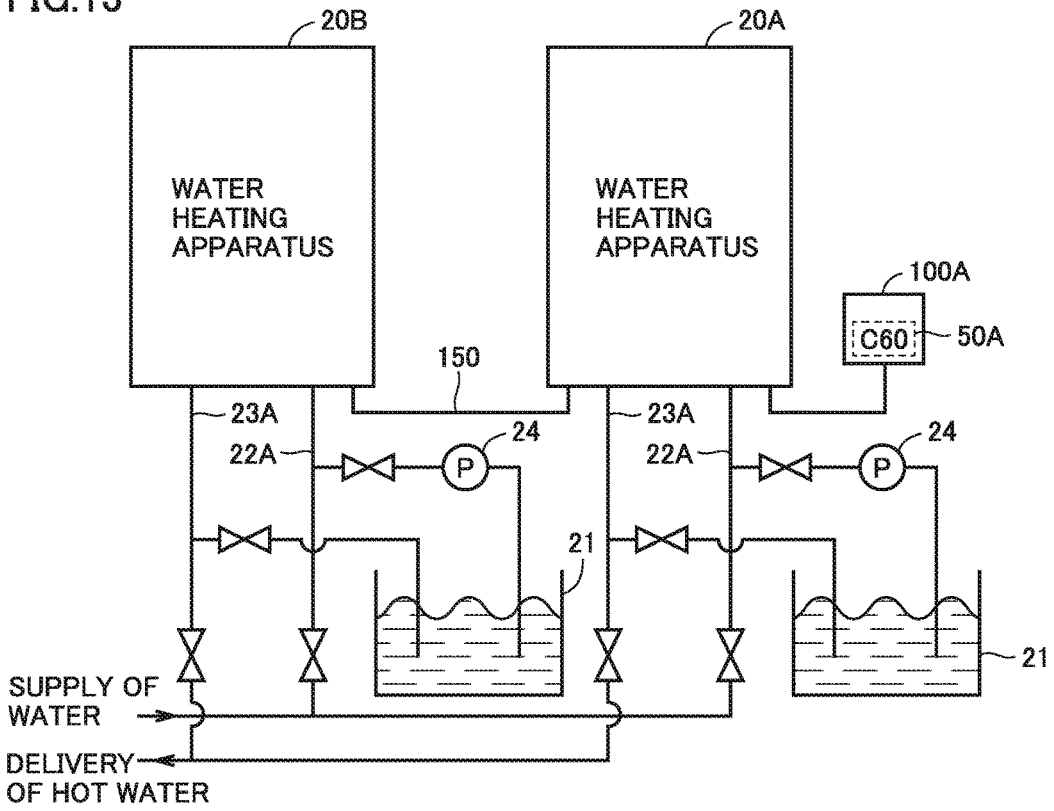
FIG. 13 is a schematic configuration diagram of a water heating system 120 according to the fifth embodiment.

The present fifth embodiment provides a modification of each of the above-described embodiments. The present fifth embodiment represents a method of implementing the cleaning mode in water heating system 120 in which two water heating apparatuses 20 are coupled to each other. FIG. 13 is a schematic configuration diagram of water heating system 120 according to the fifth embodiment. In addition, in the present embodiment, when the cleaning mode for all of water heating apparatuses 20 in water heating system 120 is ended, the data for giving a notification about the completion of the cleaning mode is output.

Referring to FIG. 13, water heating system 120 includes two water heating apparatuses 20A and 20B coupled to each other. Water heating apparatus 20A is connected to water heating apparatus 20B through a coupling code 150 serving as a communication cable. Based on the operation of a switch (not shown), controller 10 in each water heating apparatus selects one of the master program and the slave program that are stored in storage unit 10*f*, and starts the selected program. Thereby, each water heating apparatus 20 is operated as one of a master apparatus and a slave apparatus. In the present fifth embodiment, water heating apparatus 20A is a master water heating apparatus with a display device 100A connected thereto, and water heating apparatus 20B is a slave water heating apparatus. Master water heating apparatus 20A relays communication between slave water heating apparatus 20B and display device 100A. FIG. 13 shows the state where each of two water heating apparatuses 20A and 20B is in the cleaning mode.

Master water heating apparatus 20A generally controls both water heating apparatuses 20A and 20B. On the other hand, slave water heating apparatus 20B implements permission for combustion only when the hot water supply operation is permitted by a control signal issued from master water heating apparatus 20A.

Display device 100A corresponds to a computer configured to display the information regarding operations of water heating apparatuses 20A and 20B on a display unit 50A. Display unit 50A includes a liquid crystal and the like. Based on the display data received from water heating apparatus 20A, display device 100A displays images (numbers, characters, pictures, marks, and the like) on display unit 50A. Since the configuration and the operation of each of water heating apparatuses 20A and 20B are basically the same as those shown in FIGS. 1, 2 and 5, the description thereof will not be repeated.

Figure 14:
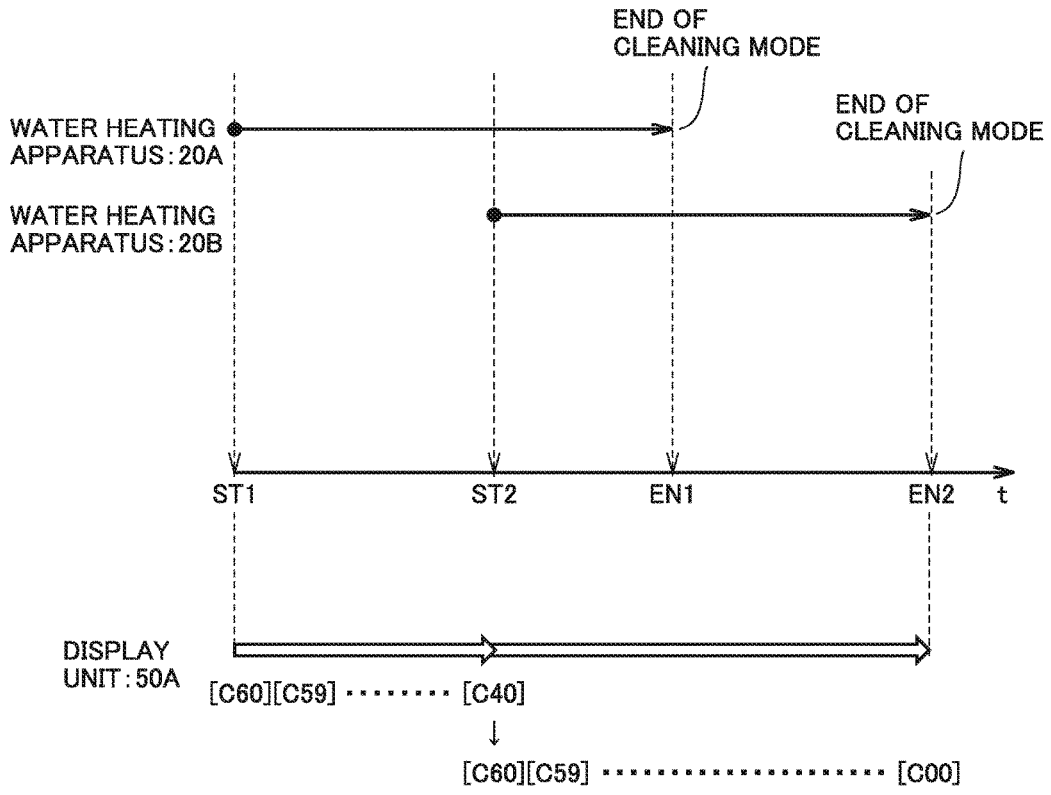
FIG. 14 is a diagram illustrating display of a remaining time in the cleaning mode according to the fifth embodiment.
Figure 15:
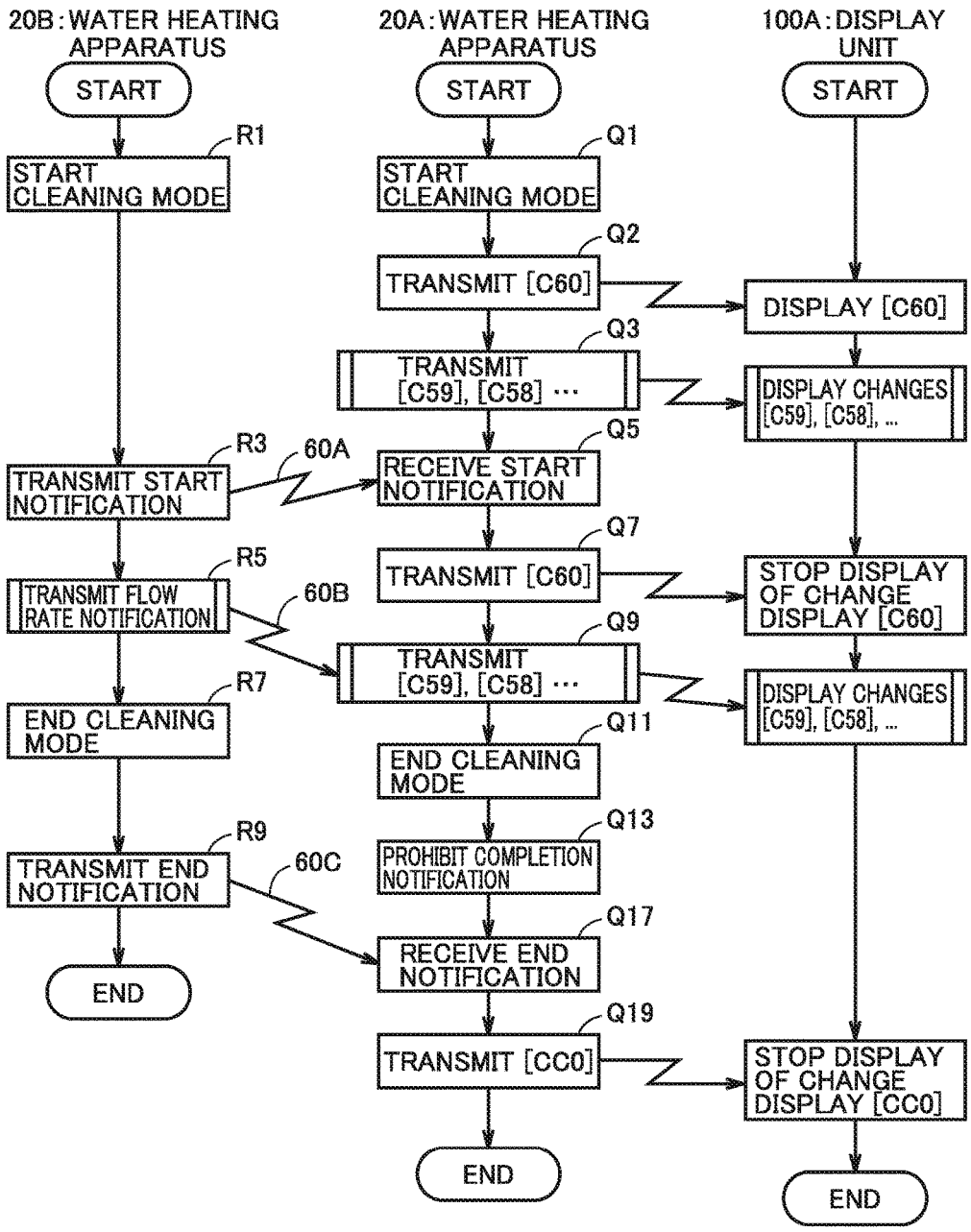
FIG. 15 is a process flowchart according to the fifth embodiment.

FIG. 14 is a diagram illustrating display of the remaining time in the cleaning mode according to the fifth embodiment. FIG. 14 show changes in the remaining time of the cleaning mode displayed on display unit 50A in accordance with the progress of time t. FIG. 15 is a process flowchart according to the fifth embodiment. The program on the water heating apparatus 20 side according to the flowchart in FIG. 15 is stored in storage unit 10*f* of water heating apparatus 20. When the MPU in controller 10 executes the program, the process is implemented. The program on the display device 100A side according to the flowchart in FIG. 15 is stored in a storage unit (not shown) of display device 100A. When the CPU (not shown) in display device 100A executes the program, the process is implemented. An explanation will be hereinafter given according to the flowchart in FIG. 15 with reference to FIG. 14 with regard to the case where water heating apparatus 20A first shifts to a cleaning mode and then water heating apparatus 20B shifts to a cleaning mode.

When water heating apparatus 20A starts the cleaning mode at time ST1 in FIG. 14 (step Q1), water heating apparatus 20A generates display data for indicating the remaining time [C60] of the required time period (60 minutes) as a start notification for indicating the start of the cleaning mode, and then, transmits the generated display data to display device 100A (step Q2). Display device 100A displays [C60] on display unit 50A according to the display data from water heating apparatus 20A.

Then, each time a predetermined flow rate is detected based on the output from flow rate sensor 13, water heating apparatus 20A subtracts the required time period, generates display data for indicating the remaining time obtained by subtraction (for example, [C59], [C58], . . . in FIG. 14), and transmits the generated display data to display device 100A (step Q3). In this way, by transmitting the display data each time the predetermined flow rate is detected, display device 100A receives the time-series display data for changing the image so as to show the progress of time from the start of the cleaning mode (in this case, the progress of the remaining time). Display device 100A causes display unit 50A to display an image ([C59], [C58], . . . ) that change in time series according to the time-series display data.

When water heating apparatus 20B starts the cleaning mode at time ST2 after the cleaning mode of water heating apparatus 20A has been started (step R1), water heating apparatus 20B transmits mode start notification 60A (step R3). When water heating apparatus 20A receives mode start notification 60A from water heating apparatus 20B (step Q5), it determines based on mode start notification 60A that slave water heating apparatus 20B has shifted to the cleaning mode.

When controller 10 in water heating apparatus 20A receives mode start notification 60A from slave water heating apparatus 20B as described above during transmission of the above-described time-series display data to display device 100A, this controller 10 stops transmission of the time-series display data. Then, controller 10 generates display data for indicating the remaining time [C60] as a start notification for the cleaning mode of water heating apparatus 20B, and transmits the generated display data to display device 100A (step Q7). Therefore, on display unit 50A of display device 100A, changing of the image showing the progress of time from the start of the cleaning mode of water heating apparatus 20A is stopped. Then, in place of the above-mentioned image, [C60] corresponding to the start notification for the cleaning mode of water heating apparatus 20B is displayed. For example, the image on display unit 50A is changed from [C40] to [C60] (see FIG. 14).

After that, each time the predetermined flow rate is detected, water heating apparatus 20B transmits flow rate notification 60B to water heating apparatus 20A (step R5). Each time controller 10 in water heating apparatus 20A receives flow rate notification 60B from water heating apparatus 20B, this controller 10 generates display data for indicating the remaining time (for example, [C59], [C58], . . . in FIG. 14) and transmits the generated display data to display device 100A (step Q9), as in the above-described step Q3. Thereby, the image that changes in time series ([C59], [C58], . . . ) is displayed on display unit 50A, to thereby give a notification about the progress of time from the start of the cleaning mode of water heating apparatus 20B (the progress of the remaining time).

In this way, when controller 10 in master water heating apparatus 20A transmits display data based on mode start notification 60A during transmission, to display device 100A, of the time-series display data for changing the image so as to show the progress of the cleaning mode, this controller 10 stops transmission of the time-series display data, and again starts transmission of the time-series display data for indicating the progress from the start of the cleaning mode.

Water heating apparatus 20A ends the cleaning mode (time EN1 in FIG. 14). In this case, based on whether it has received mode end notification 60C from water heating apparatus 20B, controller 10 in water heating apparatus 20A determines whether water heating apparatus 20B is currently implementing the cleaning mode or not. In this case, it is determined that water heating apparatus 20B is currently implementing the cleaning mode. Controller 10 in water heating apparatus 20A prohibits transmission of the display data for giving a notification about the completion of the cleaning mode through communication interface 114 (steps Q11 and Q13).

When water heating apparatus 20B ends the cleaning mode at time EN2 in FIG. 14 (step R7), water heating apparatus 20B transmits mode end notification 60C (step R9). When controller 10 of water heating apparatus 20A receives mode end notification 60C from water heating apparatus 20B (step Q17), controller 10 determines based on the received mode end notification 60C that the cleaning mode of water heating apparatus 20B has ended, that is, the cleaning mode in water heating system 120 has been completed. Based on the determination result, controller 10 stops transmission of the time-series display data showing the progress of the cleaning mode of water heating apparatus 20B. Instead, controller 10 generates display data indicating a completion notification about the cleaning mode and transmits the generated display data to display device 100A (step Q19). Display device 100A displays, on display unit 50A, the image based on the display data of the completion notification from water heating apparatus 20A. Thereby, on display unit 50A, changing of the image showing the above-described progress of time in the cleaning mode of water heating apparatus 20B is stopped. Then, in place of this image, an image of the completion notification (for example, [CC0]) is displayed.

Thereby, when the cleaning mode is implemented in water heating apparatuses 20A and 20B, the image indicating completion of the cleaning mode ([CC0]) can be displayed on display unit 50A so as to coincide with the ending time of the cleaning mode of water heating apparatus 20B, which is ended last.

In the fifth embodiment, master water heating apparatus 20A shifts to a cleaning mode prior to slave water heating apparatus 20B. However, even when slave water heating apparatus 20B shifts to a cleaning mode prior to master water heating apparatus 20A, the process in FIG. 15 can be similarly performed. Furthermore, when one of water heating apparatuses 20A and 20B implements a cleaning mode (the other water heating apparatus implements a normal mode), master water heating apparatus 20A displays, on display unit 50A, the data that changes so as to show the progress of time from the start of the cleaning mode of one water heating apparatus.

In addition, the data that changes so as to show the progress of the cleaning mode is not limited to the data showing the above-described progress of time, but may be data showing the changes in cumulative flow rate that is obtained by accumulating the cleaning liquid flowing through heat exchanger 3 from the start to the end of the cleaning mode, as in the fourth embodiment. As an image showing the progress of the cleaning mode, display unit 50A may display one or both of the image showing the time and the image showing the cumulative flow rate.

Also, display unit 50A may display an image based on ID data 125 of water heating apparatus 20 that is currently implementing the cleaning mode. Thereby, it becomes possible to give a notification about: the identifier of water heating apparatus 20 currently implementing the cleaning mode; and the image (time, cumulative flow rate) showing the progress of the cleaning mode.

In addition, in the fifth embodiment, master water heating apparatus 20A transmits display data to display device 100A. However, in place of the display data, master water heating apparatus 20A may transmit mode start notification 60A, flow rate notification 60B and the completion notification about the cleaning mode to display device 100A. In this case, the CPU in display device 100A generates display data according to these notifications received from water heating apparatus 20A, and drives display unit 50A according to the generated display data.

In addition, even in the case of water heating system 110 of the multi-coupled-type water heater in the fourth embodiment, by the same method as that in the fifth embodiment, based on mode start notification 60A, flow rate notification 60B and mode end notification 60C that are received from each water heating apparatus 20, CPU 101 in controller 100 can display, on output unit 105, the image of the completion notification about the cleaning mode so as to coincide with the ending time of the cleaning mode of water heating apparatus 20C among water heating apparatuses 20A, 20B and 20C in which the cleaning mode is ended last.

(Modification)

The above-described elapsed time of the cleaning mode is counted based on a predetermined time period (60 minutes), but the predetermined time period may be changed based on the conditions of water heating apparatus 20. For example, examples of the conditions may be the detection temperature of water heater body thermistor 8, the number of times that water heating apparatus 20 implemented the cleaning mode in the past, and the interval between which the cleaning mode is implemented. These conditions depend, for example, on the water quality (hardness) of water to be supplied to water heating apparatus 20, the time indicating cumulative combustion time, and the like. Thus, the predetermined time period is changed based on such conditions, so that the required time period (or remaining time) of the cleaning mode that matches the conditions of each water heating apparatus 20 can be counted and displayed.

The information about the cleaning mode of each of master water heating apparatus 20A and slave water heating apparatus 20B may be displayed on display unit 11 of water heating apparatus 20A, in place of external display device 100A or together with display device 100A.

Although the embodiments of the present invention have been described, it should be understood that the embodiments disclosed herein are illustrative and non-restrictive in every respect. The scope of the present invention is defined by the terms of the claims, and is intended to include any modifications within the meaning and scope equivalent to the terms of the claims.

What is claimed is:

1. A water heating apparatus comprising:
a water heating circuit;
a heater for heating the water heating circuit; and
a controller for controlling the water heating apparatus,
the water heating circuit including
a heat exchanger for heating a fluid including water and hot water, and
a pipe for supplying the fluid via the heat exchanger,
the pipe including a water supply pipe being connected to the heat exchanger for supplying the fluid to the heat exchanger,
the heater including a heater being placed in the water supply pipe,
the controller being configured to drive the heater placed in the water supply pipe to heat a cleaning liquid in the water heating circuit in a cleaning mode in which the cleaning liquid for cleaning an inside of the heat exchanger is supplied to the heat exchanger through the pipe.

2. The water heating apparatus according to claim 1, wherein
the heater further includes
a burner for heating the heat exchanger, and
the controller is configured to drive the burner in the cleaning mode.

3. The water heating apparatus according to claim 1, further comprising a flow rate sensor for measuring an amount of the fluid supplied to the heat exchanger, wherein
the controller is configured to end the cleaning mode when a cumulative value of a flow rate measured by the flow rate sensor from start of the cleaning mode reaches a first threshold value.

4. The water heating apparatus according to claim 2, further comprising a temperature sensor for measuring a temperature of the fluid in the heat exchanger, wherein
the controller is configured to
control the water heating apparatus so as to perform heating of the heat exchanger by the burner for a predetermined time period while causing the fluid to flow through the heat exchanger in the cleaning mode, and
to end the cleaning mode when an increased value of the temperature measured in a state where the fluid is stopped after an end of the heating is less than a second threshold value.

5. The water heating apparatus according to claim 1, further comprising a flow rate sensor for measuring an amount of the fluid supplied to the heat exchanger, wherein
the controller is configured to
accumulate, from start of the cleaning mode, a time period in which a flow rate measured by the flow rate sensor is equal to or greater than a third threshold value, to obtain a cumulative time period, and
end the cleaning mode when the cumulative time period is equal to or greater than a predetermined time period.

6. A water heating apparatus comprising:
a burner;
a heat exchanger for heating a fluid with heat from the burner, the fluid including water and hot water contained inside;
a pipe for supplying the fluid; and
a controller for controlling the water heating apparatus,
the pipe including
a supply pipe for supplying the fluid to the heat exchanger,
a delivery pipe for delivering the fluid from the heat exchanger, and
a bypass pipe for causing the fluid in the supply pipe to bypass the heat exchanger so as to be delivered to the delivery pipe, the water heating apparatus further comprising:

a bypass flow rate regulating valve for regulating a flow rate of the fluid in the bypass pipe, the controller being configured to control the bypass flow rate regulating valve to be fully closed in a cleaning mode in which the cleaning liquid is supplied from the supply pipe to the heat exchanger, and control the bypass flow rate regulating valve to be half opened in a water-passing mode in which water is supplied in place of the cleaning liquid from the supply pipe to the heat exchanger after the cleaning mode.

7. The water heating apparatus according to claim 6, further comprising a flow rate sensor for measuring an amount of the fluid supplied to the heat exchanger, wherein the controller is configured to end the cleaning mode when the controller determines that a cumulative value of a flow rate measured by the flow rate sensor from start of the cleaning mode reaches a first threshold value stored in a storage.

8. The water heating apparatus according to claim 6, further comprising a flow rate sensor for measuring an amount of the fluid supplied to the heat exchanger, wherein the controller includes a timer for measuring, from start of the cleaning mode, a time period in which a flow rate measured by the flow rate sensor is equal to or greater than a third threshold value stored in a storage, and the controller is configured to end the cleaning mode when the controller determines that the measured time period is equal to or greater than a predetermined time period.

9. A water heating system comprising:

a plurality of water heating apparatuses; and a controller for controlling an operation of each of the plurality of water heating apparatuses based on information from each of the water heating apparatuses, each of the plurality of water heating apparatuses including a burner, a heat exchanger for heating water and hot water with heat from the burner, and a controller for controlling each of the water heating apparatuses, the controller being configured to, when a cleaning mode is started, transmit a start notification indicating start of the cleaning mode to the controller, the cleaning mode being for cleaning an inside of the heat exchanger of each of the water heating apparatuses, and the controller being configured to, when the start notification is received, exclude any one of the water heating apparatuses as a sender of the start notification from a target for which the operation is to be controlled.

10. The water heating system according to claim 9, wherein the controller is configured to, when the cleaning mode is ended, transmit an end notification indicating an end of the cleaning mode to the controller, and the controller is configured to, when the end notification is received, reset any one of the water heating apparatuses as a sender of the end notification back to a target for which the operation is to be controlled.

11. The water heating system according to claim 9, wherein the controller is configured to, when the cleaning mode is ended, transmit an end notification indicating an end of the cleaning mode to the controller, and the controller is configured to when the start notification is received from one or more of the water heating apparatuses, cause an output unit to start an output of notification data for giving a notification about implementation of the cleaning mode, and when the end notification is received from each of the one or more of the water heating apparatuses, cause the output unit to end the output of the notification data.

12. The water heating system according to claim 9, wherein the controller is configured to when the start notification is received from one or more of the water heating apparatuses, cause an output unit to start an output of notification data for giving a notification about implementation of the cleaning mode, the notification data including data that changes so as to show a progress of the cleaning mode, and when the start notification is received in a middle of the cleaning mode, cause the output unit to stop changing of the data showing the progress of the cleaning mode, and again to start changing of the data so as to show a progress from start of the cleaning mode.

13. The water heating system according to claim 9, wherein the controller is configured to when the start notification is received from one or more of the water heating apparatuses, cause an output unit to start an output of notification data for giving a notification about implementation of the cleaning mode, the notification data including data that changes so as to show a progress of the cleaning mode, each of the water heating apparatuses further comprises a flow rate sensor for measuring an amount of a fluid supplied to the heat exchanger, the controller is configured to accumulate a flow rate measured by the flow rate sensor from start of the cleaning mode to obtain a cumulative flow rate, and the data that changes includes data showing a progress of a time in the cleaning mode, or data showing a change in the cumulative flow rate in the cleaning mode.

* * * * *